US010107061B2

(12) United States Patent
Stephens et al.

(10) Patent No.: US 10,107,061 B2
(45) Date of Patent: Oct. 23, 2018

(54) SYSTEMS AND METHODS FOR MONITORING A RUNNING TOOL

(71) Applicant: ONESUBSEA IP UK LIMITED, London (GB)

(72) Inventors: James Stephens, Richmond, TX (US); Alek Cywinski, Celle (DE)

(73) Assignee: ONESUBSEA IP UK LIMITED, London (GB)

( * ) Notice: Subject to any disclaimer, the term of this patent is extended or adjusted under 35 U.S.C. 154(b) by 178 days.

(21) Appl. No.: 15/188,361

(22) Filed: Jun. 21, 2016

(65) Prior Publication Data

US 2017/0362910 A1 Dec. 21, 2017

(51) Int. Cl.

| | |
|---|---|
| ***E21B 43/013*** | (2006.01) |
| ***E21B 43/01*** | (2006.01) |
| ***E21B 33/04*** | (2006.01) |
| ***E21B 47/00*** | (2012.01) |
| ***E21B 47/06*** | (2012.01) |
| ***E21B 47/10*** | (2012.01) |
| *E21B 34/00* | (2006.01) |
| *E21B 33/06* | (2006.01) |

(52) U.S. Cl.

CPC ..... *E21B 33/04* (2013.01); *E21B 47/00* (2013.01); *E21B 47/06* (2013.01); *E21B 47/065* (2013.01); *E21B 47/10* (2013.01); *E21B 47/101* (2013.01); *E21B 33/061* (2013.01); *E21B 2034/002* (2013.01)

(58) Field of Classification Search

CPC ..... E21B 7/122; E21B 7/128; E21B 41/0014; E21B 41/0007; E21B 41/04; E21B 41/38; E21B 41/0085; E21B 43/01; E21B 43/013

See application file for complete search history.

(56) References Cited

U.S. PATENT DOCUMENTS

| | | | | |
|---|---|---|---|---|
| 4,862,426 | A * | 8/1989 | Cassity | E21B 33/0355 166/335 |
| 6,725,924 | B2 * | 4/2004 | Davidson | E21B 33/0355 166/250.01 |
| 7,231,970 | B2 | 6/2007 | Matusek et al. | |
| 7,762,338 | B2 | 7/2010 | Fenton et al. | |
| 7,938,178 | B2 * | 5/2011 | Ringgenberg | E21B 47/065 166/242.6 |
| 8,322,428 | B2 * | 12/2012 | Jennings | E21B 47/09 166/250.01 |
| 8,672,040 | B2 | 3/2014 | Kobata et al. | |
| 8,759,993 | B2 * | 6/2014 | Coonrod | F03G 7/08 290/1 R |
| 9,103,204 | B2 * | 8/2015 | Yates | E21B 47/18 |
| 9,869,174 | B2 * | 1/2018 | Szpunar | E21B 47/091 |
| 2009/0212969 | A1 | 8/2009 | Voss | |
| 2011/0226490 | A1 | 9/2011 | Nguyen | |
| 2012/0098674 | A1 | 4/2012 | McStay et al. | |

(Continued)

*Primary Examiner* — Kenneth L Thompson

(74) *Attorney, Agent, or Firm* — Fletcher Yoder, P.C.

(57) ABSTRACT

A mineral extraction system may include a running tool configured to install a wellhead component in a wellhead assembly. The mineral extraction system may also include a plurality of sensors configured to monitor parameters of the running tool during the process of installing the wellhead component. Additionally, the mineral extraction system may include a controller configured to receive signals from the sensors and to provide indications based on the signals.

20 Claims, 17 Drawing Sheets

(56) References Cited

U.S. PATENT DOCUMENTS

| | | | |
|---|---|---|---|
| 2013/0056218 | A1 | 3/2013 | McCoy, Jr. et al. |
| 2014/0014334 | A1 | 1/2014 | Mason et al. |
| 2014/0251630 | A1 | 9/2014 | Reimert et al. |

* cited by examiner

SYSTEMS AND METHODS FOR MONITORING A RUNNING TOOL

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are a common source of fuel for a variety of applications. For example, oil and gas are often used to heat homes, to power vehicles, and to generate electrical power. Drilling and production systems are typically employed to access, extract, and otherwise harvest desired natural resources, such as oil and gas, that are located below the surface of the earth. These systems may be located onshore or offshore depending on the location of the desired natural resource. Further, such systems generally include a wellhead assembly through which the resource is extracted. These wellhead assemblies may include a wide variety of components, such as various casings, hangers, valves, fluid conduits, and the like, that control drilling and/or extraction operations.

In some drilling and production systems, hangers, such as a casing hanger, may be used to suspend strings (e.g., piping for various flows in and out of the well) of the well. Such hangers may be disposed within a spool of a wellhead which supports both the hanger and the string. For example, a casing hanger may be lowered into a casing spool by a drilling string. During the running or lowering process, the casing hanger may be latched to a running tool, such as a casing hanger, seal assembly running tool (CHSART), thereby coupling the casing hanger to the drilling string. Once the casing hanger has been lowered into a landed position within the casing spool, the CHSART may be used to cement and seal the casing hanger into position. The CHSART may then be unlatched from the casing hanger and extracted from the wellhead by the drilling string.

BRIEF DESCRIPTION

The present disclosure describes a mineral extraction system comprising a running tool configured to carry and install a wellhead component in a wellhead assembly during an installation process; a plurality of sensors, each sensor of the plurality of sensors being configured to generate a signal indicative of at least one parameter of a plurality of parameters of the running tool during the installation process; a controller disposed on a base vessel, the controller being in wireless communication with the plurality of sensors, and the controller being configured to receive the signal from each sensor of the plurality of sensors, to determine the plurality of parameters of the running tool based on the signals received from the plurality of sensors, and to provide one or more user-perceivable indications based on the plurality of parameters.

According to some embodiments, a subsea mineral extraction system is described comprising a running tool configured to carry a casing hanger and a seal assembly, to land the casing hanger in wellhead housing of a subsea wellhead assembly, and to set the seal assembly between the casing hanger and the wellhead housing during an installation process. The running tool comprises a mandrel configured to couple to a drill string configured to lower the running tool into the wellhead housing; a central bore extending through the mandrel and axially along a longitudinal axis of the running tool; a tool body coupled to the mandrel, the tool body being configured to carry the casing hanger and the seal assembly; a shuttle disposed about the tool body, the shuttle being sealed to the tool body via one or more seals, and the shuttle and the mandrel being configured to move axially along the longitudinal axis of the running tool relative to the tool body to set the seal assembly; and a plurality of sensors, each sensor of the plurality of sensors being configured to generate a signal indicative of at least one parameter of a plurality of parameters of the running tool during the installation process, and one or more sensors of the plurality of sensors being configured to generate a first signal indicative of an axial position of the mandrel relative to the tool body and a second signal indicative of an axial position of the shuttle relative to the tool body.

According to some embodiments, the present disclosure describes a method of monitoring a running tool comprising receiving a plurality of signals from a plurality of sensors, determining a plurality of parameters of the running tool based on the plurality of signals and providing one or more user-perceivably indications based on the plurality of parameters. Each sensor of the plurality of sensors is configured to generate a signal indicative of at least one parameter of the running tool during an installation process executed using the running tool, wherein, during the installation process, the running tool is configured to carry a casing hanger and a seal assembly, to land the casing hanger in a wellhead housing of a wellhead assembly, and to set the seal assembly between the casing hanger and the wellhead housing. The plurality of parameters comprise a position of the running tool relative to the wellhead housing, an elevation of the running tool relative to a base vessel, a position of a valve of the running tool, a distance travelled by the seal assembly relative to the running tool, a pressure of a fluid flowing through the running tool, or a combination thereof.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION

Figure 1:
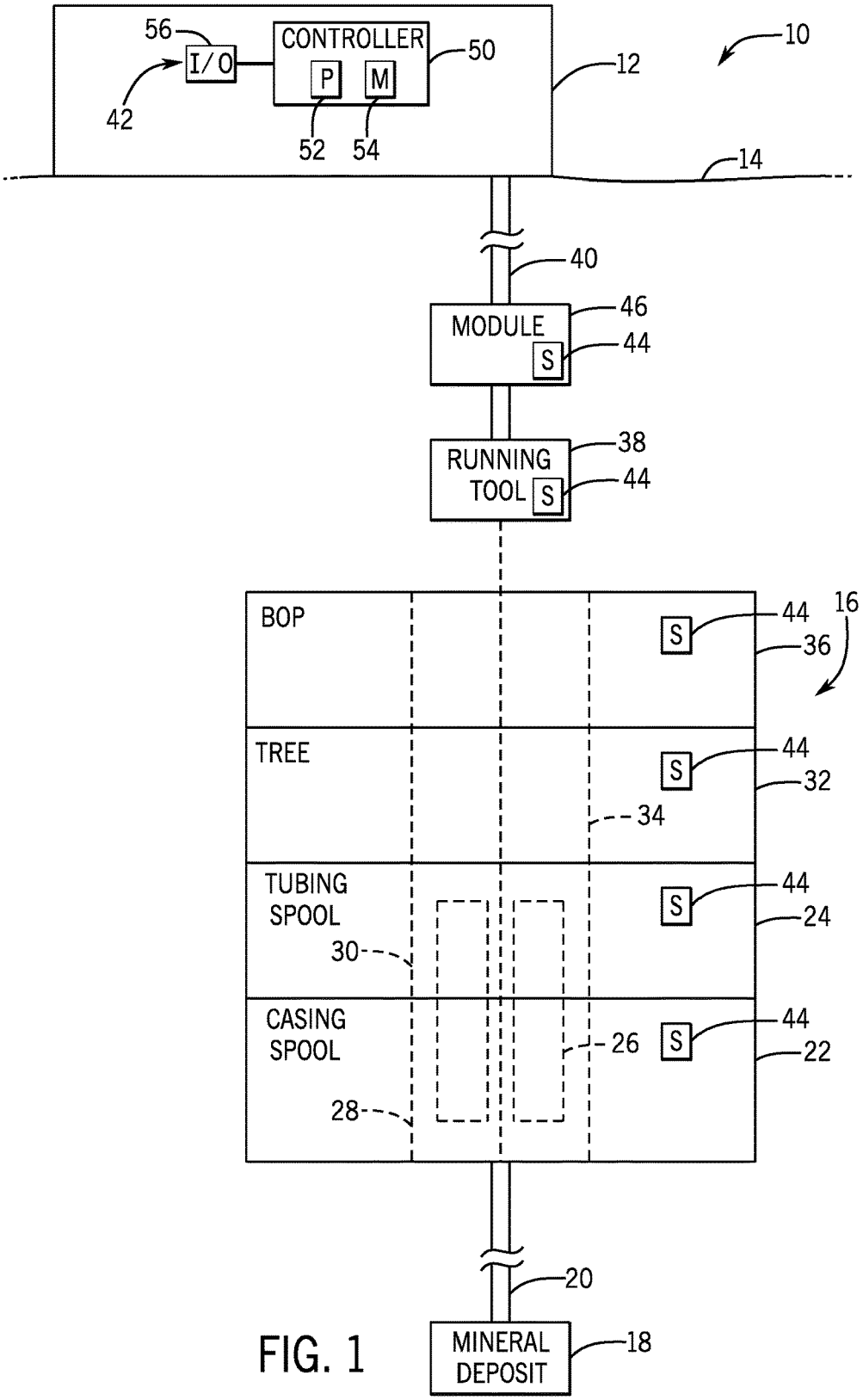
FIG. 1 is a schematic view of an embodiment of a mineral extraction system including a wellhead assembly, a running tool configured to install a wellhead component in the wellhead assembly, and a control system configured to monitor the running tool.

One or more specific embodiments of the present disclosure will be described below. These described embodiments are only exemplary of the present disclosure. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The drawing figures are not necessarily to scale. Certain features of the embodiments may be shown exaggerated in scale or in somewhat schematic form, and some details of conventional elements may not be shown in the interest of clarity and conciseness. Although one or more embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

When introducing elements of various embodiments of the present disclosure, the articles "a," "an," and "the" are intended to mean that there are one or more of the elements. The terms "comprising," "including," and "having" are used in an open-ended fashion, and thus should be interpreted to mean "including, but not limited to . . . ". Any use of any form of the terms "connect," "engage," "couple," "attach," "mate," "mount," or any other term describing an interaction between elements is intended to mean either an indirect or a direct interaction between the elements described. As used herein, the terms "upper," "top," or the like refer to an element that is relatively closer to a surface of the earth, while the terms "lower," "bottom," or the like refer to an element that is relatively farther from the surface of the earth.

Certain terms are used throughout the description and claims to refer to particular features or components. As one skilled in the art will appreciate, different persons may refer to the same feature or component by different names. This document does not intend to distinguish between components or features that differ in name but not function, unless specifically stated.

As discussed below, a variety of systems may include hangers, such as a casing hanger, which may be used to suspend strings (e.g., piping for various flows in and out of the well) of the well. For example, a casing hanger may be lowered into a casing spool by a drilling string. During the running or lowering process, the casing hanger may be latched to a running tool, such as a casing hanger, seal assembly running tool (CHSART). The CHSART may be used to run, land, cement, and seal the casing hanger into position. Unfortunately, it may be difficult to determine whether the casing hanger has properly landed, cemented, and sealed, particularly in subsea systems where the well and casing spool are located thousands of feet below the surface of the ocean. In some cases, the CHSART is retrieved and visually inspected at the surface to determine whether the casing hanger was properly installed. If the operator suspects or determines that the casing hanger was not properly installed, the casing hanger may be retrieved and re-reinstalled, which may increase the non-productive time and expensive of the well.

The present disclosure is directed to embodiments of a system and method for monitoring an installation process (e.g., a running process) of a wellhead component. As discussed below, the disclosed embodiments include a running tool (e.g., an installation tool) configured to run (e.g., lower) and land the wellhead component into a wellhead during an installation process. In some embodiments, the running tool may also be configured to cement and/or seal the wellhead component in place in the wellhead during the installation process. For example, the running tool may be a casing hanger, seal assembly running tool (CHSART) that is configured to run, land, cement, and seal a casing hanger into a casing spool. Additionally, as discussed below, the disclosed embodiments include one or more sensors configured to generate feedback relating to parameters of the running tool and/or an installation process implemented (e.g., executed, performed, etc.) using the running tool. For example, one or more sensors may be disposed in or on the running tool, the wellhead component, a drill string configured to suspend the running tool, and/or a module coupled to the drill string. In some embodiments, the sensors may generate feedback relating to a position of the running tool relative to the wellhead assembly and/or the wellhead component, a state (e.g., open or closed) of a valve of the running tool, a state or condition (e.g., intact or broken) of indicator pins or bolts of the running tool, and so forth.

Additionally, as discussed below, the disclosed embodiments include a controller configured to receive the sensor feedback and to provide user-perceivable indications, recommendations, and/or alerts based on the sensor feedback. For example, the controller may provide user-perceivable indications, recommendations, and/or alerts relating to one or more steps of the installation process (e.g., running, landing, cementing, sealing, etc.), which may enable an operator to determine whether or not the one or more steps of the installation process were properly executed. In particular, the controller may provide the user-perceivable indications, recommendations, and/or alerts during the installation process and/or while the running tool is suspended below the surface of the earth. In this manner, the system may reduce the likelihood of an improper installation and, in the event that a step of the installation process was not properly executed, the system may enable an operator to resolve the issue without bringing the running tool to the surface. Thus, the system may reduce the non-productive time and expensive of the well.

FIG. 1 is a block diagram of an embodiment of a mineral extraction system 10. The mineral extraction system 10 may be configured to extract various minerals and natural resources, such as oil, gas, and/or hydrocarbons, from the earth, or to inject substances into the earth. In some embodiments, the mineral extraction system 10 is land-based (e.g., a surface system) or subsea (e.g., a subsea system). The mineral extraction system 10 may include a surface vessel 12, such as a rig or platform, generally located at a surface 14 of the earth and a wellhead assembly 16 (e.g., a subsea wellhead assembly) disposed at a distance or depth below the surface 14. The wellhead assembly 16 may be coupled to (e.g., in fluid communication with) a mineral deposit 18 via a well 20 (e.g., a wellbore).

The wellhead assembly 16 may include a casing spool 22 (e.g., casing, wellhead housing, etc.), a tubing spool 24 (e.g., tubing hanger, wellhead housing, etc.), and one or more hangers 26 (e.g., casing hanger and/or a tubing hanger). The one or more hangers 26 may be disposed within the casing spool 22 and/or the tubing spool 24 and may be connected to a string (e.g., a tubing string or a casing string) to suspend the string within the well 20. The casing spool 22 and the tubing spool 24 may include a casing spool bore 28 and a tubing spool bore 30, respectively, to provide access to the well 20.

Additionally, in some embodiments, the wellhead assembly 16 may include a tree 32 (e.g., a Christmas tree), which may be coupled to the tubing spool 24. The tree 32 generally includes a variety of flow paths, valves, fittings, and controls for operating the well 20. Additionally, the tree 32 may include a tree bore 34 to provide access to the well 20 for various completion and workover procedures, such as the insertion of tools into the well 20, the injection of various chemicals into the well 20, and so forth. Further, a blowout preventer (BOP) 36 may be included, either as a part of the tree 32 or as a separate device. The BOP 36 may include a variety of valves, fittings, and controls to block or prevent oil, gas, and/or other fluids from exiting the well 20 in the event of an unintentional release of pressure or an overpressure condition.

The mineral extraction system 10 may also include a running tool 38 configured to run (e.g., lower), land, cement, and/or seal a component (e.g., a wellhead component) into the wellhead assembly 16 during an installation process for the respective component. For example, the running tool 38 may be suspended from a drill string 40 (e.g., drill pipe) that is run (e.g., lowered) from the surface vessel 12. In some embodiments, the running tool 38 (e.g., a casing hanger running tool (CHRT), a casing hanger, seal assembly running tool (CHSART), a tubing hanger running tool (THRT), etc.) may be configured to run the hanger 26 into the wellhead assembly 16 (e.g., in the casing spool 22 and/or the tubing spool 24). In certain embodiments, the running tool 38 may be configured to circulate cement to cement casing suspended by the hanger 26 into place in the wellhead assembly 16. Further, in certain embodiments, the running tool 38 may be configured to set one or more seals (e.g., metal-to-metal seals, parallel bore metal (PBM) metal seals) between the hanger 26 and the casing spool 22 and/or the tubing spool 24.

Additionally, as discussed in more detail below, the mineral extraction system 10 may include a control system 42 (e.g., an installation monitoring system, a running tool monitoring system, etc.) configured to monitor one or more parameters of the running tool 38 and/or one or more steps of an installation process implemented using the running tool 38. In particular, the control system 42 may include one or more sensors 44 configured to generate feedback relating to parameters of the running tool 38 and/or an installation process for the component (e.g., the hanger 26) during the installation process. The sensors 44 may include temperature sensors, flow sensors (e.g., flow meters), pressure sensors (e.g., strain gauges, load cells, weight sensors, piezoelectric sensors, potentiometers, etc.), acoustic sensors, motion sensors (e.g., rotation sensors, elevation sensors, depth sensors, vibration sensors, accelerometers, inclinometers, gyroscopes, etc.), proximity sensors (e.g., optical sensors, Hall effect sensors, radar sensors, sonar sensors, ultrasound sensors, Doppler effect sensors, Eddy current sensors, inductive sensors, etc.) or any other suitable sensor. The sensors 44 may be configured to measure or detect temperature, flow rate, pressure, weight, position, proximity, motion, rotation, depth, elevation, sound (e.g., acoustic waves or signals), electromagnetic radiation (e.g., light), or any other suitable parameter.

For example, as described in more detail below, the sensors 44 may generate feedback relating to the position of the running tool 38, such as the depth or elevation of the running tool 38 relative to the surface 14 and/or the position (e.g., axial position) of the running tool 38 relative to one or more components of the wellhead assembly 16. In certain embodiments, the sensors 44 may generate feedback relating to the position of one or more components of the running tool 38 (e.g., a mandrel, a shuttle, flow ports, cam-actuated dogs, etc.) relative to other components of the running tool 38 and/or relative to one or more components of the wellhead assembly 16. In some embodiments, the sensors 44 may generate feedback relating to a state (e.g., open or closed, sheared or not sheared, broken or unbroken, etc.) of one or more components of the running tool 38 (e.g., shear pins, tensile bolts, valves, etc.). In certain embodiments, the sensors 44 may generate feedback relating to a pressure and/or flow rate of fluid in the drill string 40 and/or in one or more bores and/or flow passages of the running tool 38. In some embodiments, the sensors 44 may generate feedback relating to a position or state of one or more seals configured to form a seal between the component (e.g., the hanger 26) suspended by the running tool 38 and the wellhead assembly 16. Further, the sensors 44 may generate feedback relating to the position of a component (e.g., the hanger 26) relative to the surface 14 and/or relative to one or more components of the wellhead assembly 16.

The sensors 44 may be disposed in any suitable locations of the mineral extraction system 10. In some embodiments, the sensors 44 may be disposed in or on (e.g., coupled to and/or integral with) the running tool 38. In certain embodiments, the sensors 44 may be disposed in or on (e.g., coupled to and/or integral with) the drill string 40, the hanger 26, a string (e.g. casing string, tubing string, and/or drilling string) coupled to the running tool 38, a string (e.g. casing string, tubing string, and/or drilling string) coupled to the hanger 26, the casing spool 22, the tubing spool 24, the tree 32, the BOP 36, and/or any other components of the wellhead assembly 16. In certain embodiments, the sensors 44 may be disposed in or on another tool or a remotely operated vehicle (ROV). In some embodiments, the sensors 44 may be disposed in a module 46 (e.g., a running tool module, a sensor module, etc.), which may be coupled to the drill string 40 and disposed above the running tool 38 (e.g., closer to the surface 14 than the running tool 38).

Further, the control system 42 may include a controller 50, which may be located at the surface 14. For example, the controller 50 may be disposed on the surface vessel 12. The controller 50 may be configured to monitor and/or control one or more operations of the mineral extraction system 10, such as an installation process for a wellhead component implemented by the running tool 38. As discussed in more detail below, the controller 50 may receive feedback from the sensors 44 relating to the running tool 38 and/or an installation process implemented using the running tool 38. In certain embodiments, the sensors 44 may be hardwired to the controller 50. For example, the sensors 44 may be communicatively coupled to the controller 50 via one or more wired connections, such as one or more cables disposed in the drill string 40, one or more umbilicals, and so forth. In some embodiments, as discussed below, the sensors 44 may be in wirelessly communication with the controller 40.

The controller 50 may include a processor 52 (e.g., one or more processors) and a memory 54 (e.g., one or more memories). The processor 52 may include one or more microprocessors, microcontrollers, integrated circuits, application specific integrated circuits, processing circuitry, and so forth. Additionally, the memory 54 may be provided in the form of tangible and non-transitory machine-readable medium or media (such as a hard disk drive, etc.) having instructions recorded thereon for execution by the processor 52. The instructions may include various commands that instruct the processor 52 to perform specific operations such as the methods and processes of the various embodiments described herein. The instructions may be in the form of a software program or application. The memory 54 may include volatile and non-volatile media, removable and non-removable media implemented in any method or technology for storage of information such as computer-readable instructions, data structures, program modules or other data. The computer storage media may include, but are not limited to, RAM, ROM, EPROM, EEPROM, flash memory or other solid state memory technology, CD-ROM, DVD, or other optical storage, magnetic cassettes, magnetic tape, magnetic disk storage or other magnetic storage devices, or any other suitable storage medium.

Further, in some embodiments, the controller 50 may include or may be coupled to an input and/or output (I/O) device 56. The I/O device 56 may include a computer, a laptop, a monitor, a cellular or smart phone, a tablet, another handheld device, a keyboard, a mouse, a display, a speaker, indicator lights, or the like. In some embodiments, the I/O device 56 may be configured to receive inputs, data, and/or instructions from a user and may transmit the inputs, data, and/or instructions to the controller 50. The I/O device 56 may be configured to receive data from the controller 50 and to provide one or more user-perceivable indications (e.g., visual and/or audible indications) related to the data. For example, in some embodiments, the controller 50 may cause the I/O device 56 to display user-perceivable indications, recommendations, and/or alerts based on the feedback received from the sensors 44. In some embodiments, the controller 50 may determine (e.g., in real-time or in substantially real-time) one or more parameters of the running tool 38 and/or the installation process based on the feedback from the sensors 44 and may cause the I/O device 56 to display the parameters. For example, the one or more parameters may include a depth of the running tool 38 relative to the surface 14, a position of the running tool 38 relative to the wellhead assembly 16 (e.g., the casing spool 22 and/or the tubing spool 24), a state (e.g., opened or closed) of a valve of the running tool 38, a state (e.g., broken or unbroken) of pins and/or bolts of the running tool 38, a state (e.g., sealed or unsealed) or position of a seal configured to be set by the running tool 38, a pressure and/or flow rate of fluid in the running tool 38, a weight carried by the running tool 38, a weight set on the running tool 38, or any other suitable parameter. In certain embodiments, the controller 50 may analyze the installation process based on the feedback from the sensors 44. For example, the controller 50 may determine whether one or more steps of the installation process have been properly completed and/or whether a component (e.g., the hanger 26) has been properly installed in the wellhead assembly 16 based on an analysis of the feedback from the sensors 44, and the controller 50 may cause the I/O device 56 to provide indications based on the analysis of the installation process.

Figure 2:
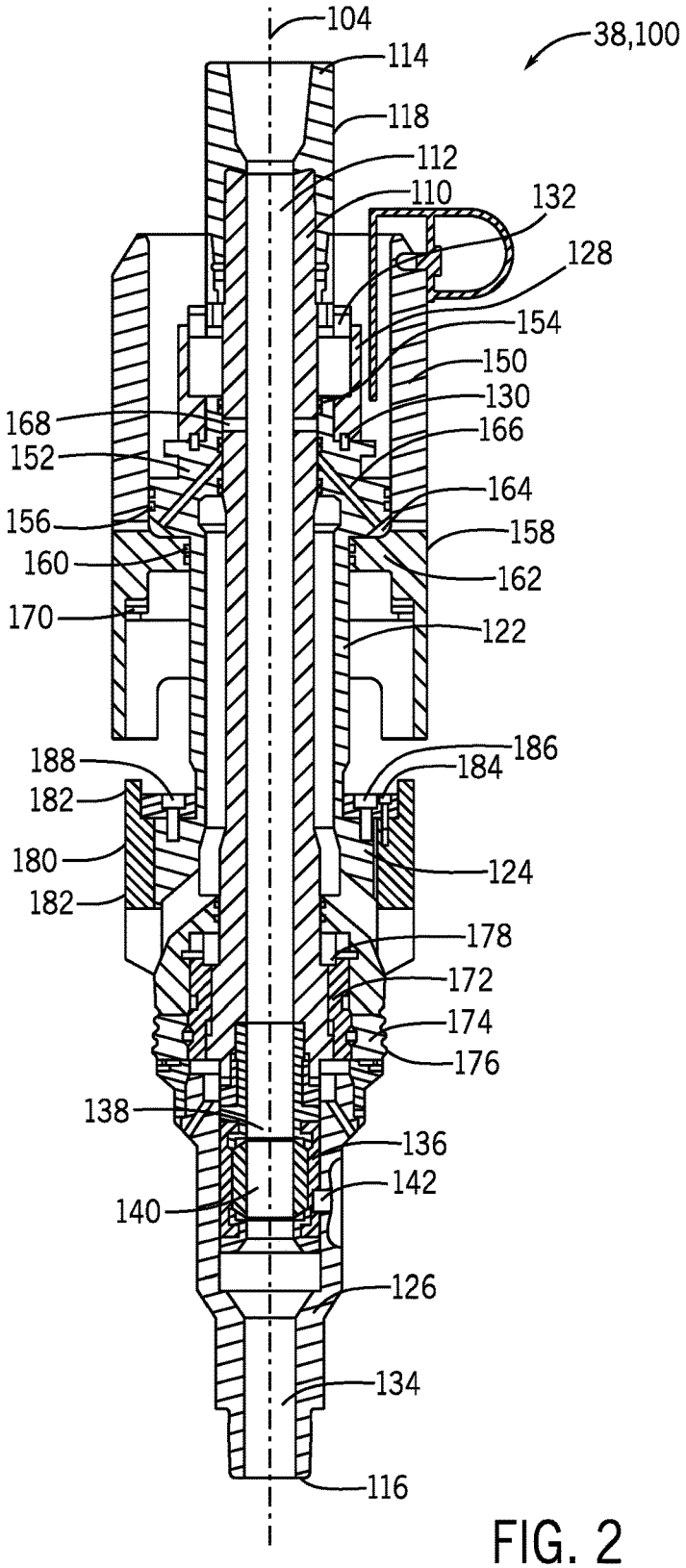
FIG. 2 is a cross-sectional view of an embodiment of a casing hanger, seal assembly running tool (CHSART)

FIG. 2 illustrates a cross-sectional view of an embodiment of the running tool 38. Specifically, FIG. 2 illustrates an embodiment of a casing hanger, seal assembly running tool (CHSART) 100. During the following discussion, reference may be made to various directions and axes, such as an axial direction 102 along a longitudinal axis 104 of the CHSART 100, a radial direction 106 away from the longitudinal axis 104, and a circumferential direction 108 around the longitudinal axis 104. As discussed in more detail below in FIGS. 3-8, the CHSART 100 may be configured to run (e.g., lower) a casing hanger and a casing string, to land the casing hanger and the casing string in the wellhead assembly 16, to circulate cement to cement the casing string in place in the well 20, and to set and test a seal between the casing hanger and the wellhead assembly 16 (e.g., the casing spool 22).

As illustrated in FIG. 2, the CHSART 100 may include a mandrel 110 (e.g., a cylindrical body, a stem, etc.) with a central bore 112 extending through the mandrel 110 and axially 102 along the longitudinal axis 104 of the CHSART 100. The CHSART 100 may include a first end 114 (e.g., an upper end) configured to couple to the drill string 40 and a second end 116 (e.g., a lower end) configured to couple to a string (e.g., a drill string, a casing string, a tubing string, etc.). In some embodiments, the first end 114 may include a connector 118 coupled to the mandrel 110, and the connector 118 may couple to the drill string 40.

Additionally, the CHSART 100 may include a tool body 120 coupled to the mandrel 110. In particular, the tool body 120 may include may include a first body 122 (e.g., an upper body), a second body 124 (e.g., a middle body, a main body), and a third body 126 (e.g., a lower body). The mandrel 110 may be configured to move in the axial direction 102 and in the circumferential direction 108 relative to the first body 122, the second body 124, and the third body 126. In some embodiments, the CHSART 100 may include a collar 128 (e.g., an annular sleeve) disposed about the mandrel 110 and configured to block movement of the mandrel 110 in the axial direction 102 and/or the circumferential direction 108 relative to the tool body 120. For example, in some embodiments, the collar 128 may be coupled to the first body 122 via one or more fasteners 130 (e.g., bolts, pins, etc.), which may block or prevent movement (e.g., in the axial direction 102 and/or the circumferential direction 108) of the collar 128 relative to the tool body 120. Further, the collar 128 may be coupled to the mandrel 110 via one or more fasteners 132 (e.g., frangible fasteners, pins, shear pins, bolts, etc.), which may block movement of the mandrel 110 (e.g., in the axial direction 102 and/or the circumferential direction 108) relative to the collar 128 and the tool body 120. As discussed below, in some embodiments, torque may be applied to the mandrel 110 above a threshold to shear (e.g., break) the fasteners 132, which may enable the mandrel 110 to move in the axial direction 102 relative to the collar 128 and the tool body 120.

As illustrated, a bore 134 may extend through the third body 126. The bore 134 may be coaxial with the central bore 112 of the mandrel 110. The CHSART 100 may include a valve 136 (e.g., a ball valve) disposed in the central bore 112 and/or the bore 134. In particular, the valve 136 may include a valve bore 138 and a flow control member 140 (e.g., a ball) disposed in the valve bore 138. The flow control member 140 may be moved between an open position and a closed position by movement of a pin 140 (e.g., a ball pin) to open and close the valve bore 138, the central bore 112 of the mandrel 110, and/or the bore 134 of the third body 126. As discussed below, the movement of the mandrel 110 in the axial direction 102 and/or the circumferential direction 108 relative to the third body 126 may control the movement of the pin 142 and thereby the position or state (e.g., open or closed) of the valve 136.

The CHSART 100 may also include a shuttle 150 (e.g., a shuttle valve, a shuttle piston, an annular sleeve, a setting sleeve, etc.) disposed about (e.g., circumferentially 108 about) the first body 122. The first body 122 may form a piston 152 with the shuttle 150 and the mandrel 110. In particular, the piston 152 may be sealed with the mandrel 110 using one or more seals 154 (e.g., annular seals) disposed between the piston 152 and the mandrel 110. Additionally, the piston 152 may be sealed with the shuttle 150 using one or more seals 156 (e.g., annular seals) disposed between the piston 152 and an outer wall 158 (e.g., an outer annular wall) of the shuttle 150. Further, the piston 152 may be sealed with the shuttle 150 using or more seals 160 (e.g., annular seals) disposed between the piston 152 and a shoulder 162 (e.g., an annular shoulder) that extends from the outer wall 158 of the shuttle 150 in the radial direction 106 toward the piston 152. A piston chamber 164 may be disposed between the shuttle 150, the piston 152, and the shoulder 162.

Figure 6:
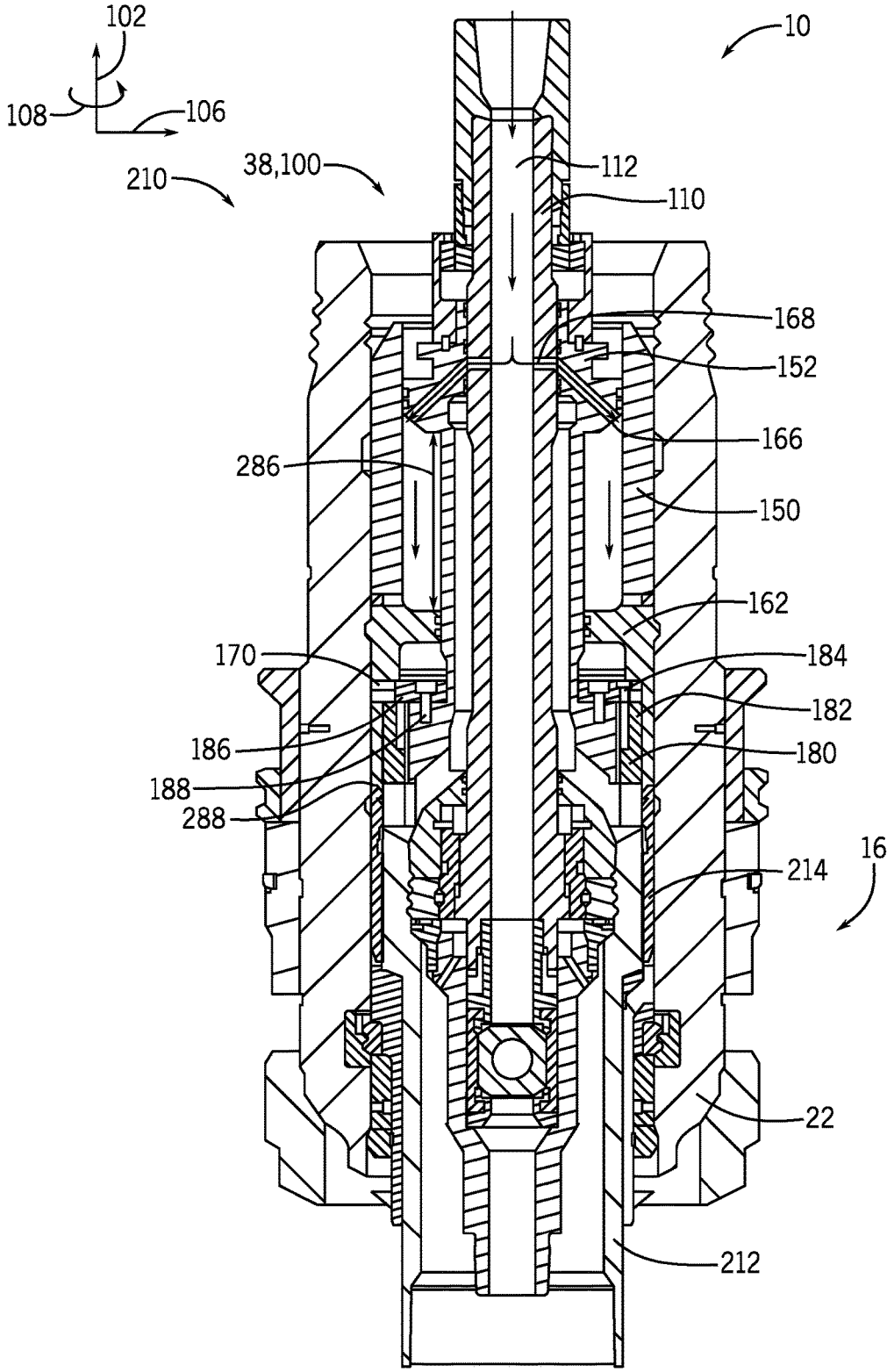
FIG. 6 is a cross-sectional view of the installation assembly of FIG. 3 during the process for setting the seal assembly using the CHSART and illustrating the shuttle of the CHSART in a second position.
Figure 7:
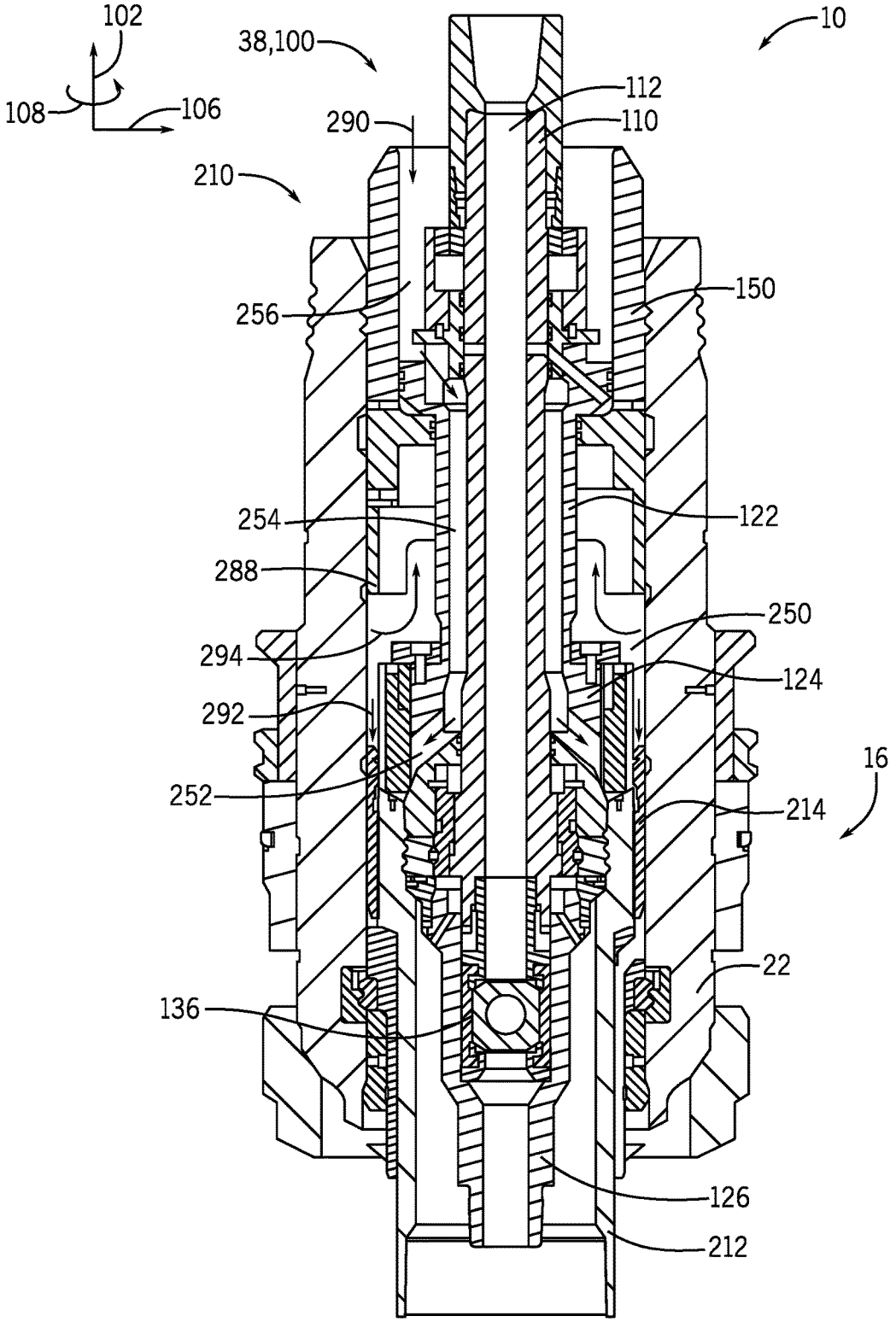
FIG. 7 is a cross-sectional view of the installation assembly of FIG. 3 during a process for testing the seal assembly using the CHSART.

The piston 152 also includes a piston port 166 extending through the piston 152. The mandrel 110 may be configured to move in the axial direction 102 relative to the first body 122 (e.g., the piston 140) to align a mandrel port 168 (e.g., a radial 106 port) extending through the mandrel 110 with the piston port 166. When the mandrel port 168 and the piston port 166 are aligned, fluid (e.g., pressurized drilling fluid) from the central bore 112 of the mandrel 110 may flow through the mandrel port 168 and the piston port 166 to the piston chamber 164. As discussed below, the fluid in the piston chamber 164 may apply a force on the shoulder 162, which may translate the shuttle 150 in the axial direction 102 relative to the mandrel 110 and the tool body 120. In particular, as discussed below, the hydraulic pressure applied to the shoulder 162 may cause the shuttle 150 to move from a first position (e.g., an upper position), as illustrated in FIG. 2, to a second position (e.g., a lower position), as illustrated in FIG. 6 to set a seal assembly between a casing hanger and the casing spool 22. Further, as discussed below, the shuttle 150 may include one or more pins 170 (e.g., frangible pins, shear pins, indicator pins, radial 106 pins, etc.), which may be sheared (e.g., distorted, broken, etc.) when the shuttle 150 is moved to the second position.

The second body 124 of the tool body 120 may include a cam ring 172 and a plurality of dogs 174 (e.g., locking dogs, cam-actuated dogs, etc.) having a plurality of shoulders 176 (e.g., grooves, protrusions, etc.). As illustrated, the cam ring 172 may be disposed circumferentially 108 about the mandrel 110, and the plurality of dogs 174 may be disposed circumferentially 108 about the cam ring 172. Movement of the cam ring 172 in the axial direction 102 may be configured to urge the dogs 174 radially 106 outward and inward relative to the mandrel 110 and the second body 124 to enable the shoulders 176 to engage and disengage with corresponding shoulders of a casing hanger. In particular, when the cam ring 172 is in a first axial 106 position, as illustrated in FIG. 2, the cam ring 172 may urge the dogs 174 into a first radial 106 position, as illustrated in FIG. 2, such that the dogs 174 may engage with corresponding shoulders of a casing hanger. Further, as discussed below in FIG. 8, the cam ring 172 may move to a second axial 106 position, which may move the dogs 174 into a second radial 106 position to release the casing hanger. Further, as discussed below, the axial 102 movement of the cam ring 172 may be controlled by the movement of a plunger 178 coupled to the mandrel 110.

Additionally, the second body 124 may include one or more latching segments 180 having one or more retaining lips 182 (e.g., protrusions, hooks, etc.). In some embodiments, the second body 124 may include a plurality of latching segments 180 spaced circumferentially 108 about the second body 124. In certain embodiments, the second body 124 may include one annular latching segment 180. The latching segments 180 may be held in a first position, as illustrated in FIG. 2, by one or more tensile bolts 184 (e.g., frangible bolts) extending through a flange 186, which may be coupled to the second body 124 via one or more fasteners 188 (e.g., bolts, tensile bolts, etc.). As discussed below, when the latching segments 180 are in the first position, the retaining lips 182 may engage (e.g., hold) a seal assembly. Further, as discussed below, the shuttle 150 may move the latching segments 188 radially 106 inward toward the mandrel 110 into a second position, which may cause the latching segments 188 to release the seal assembly.

Figure 3:
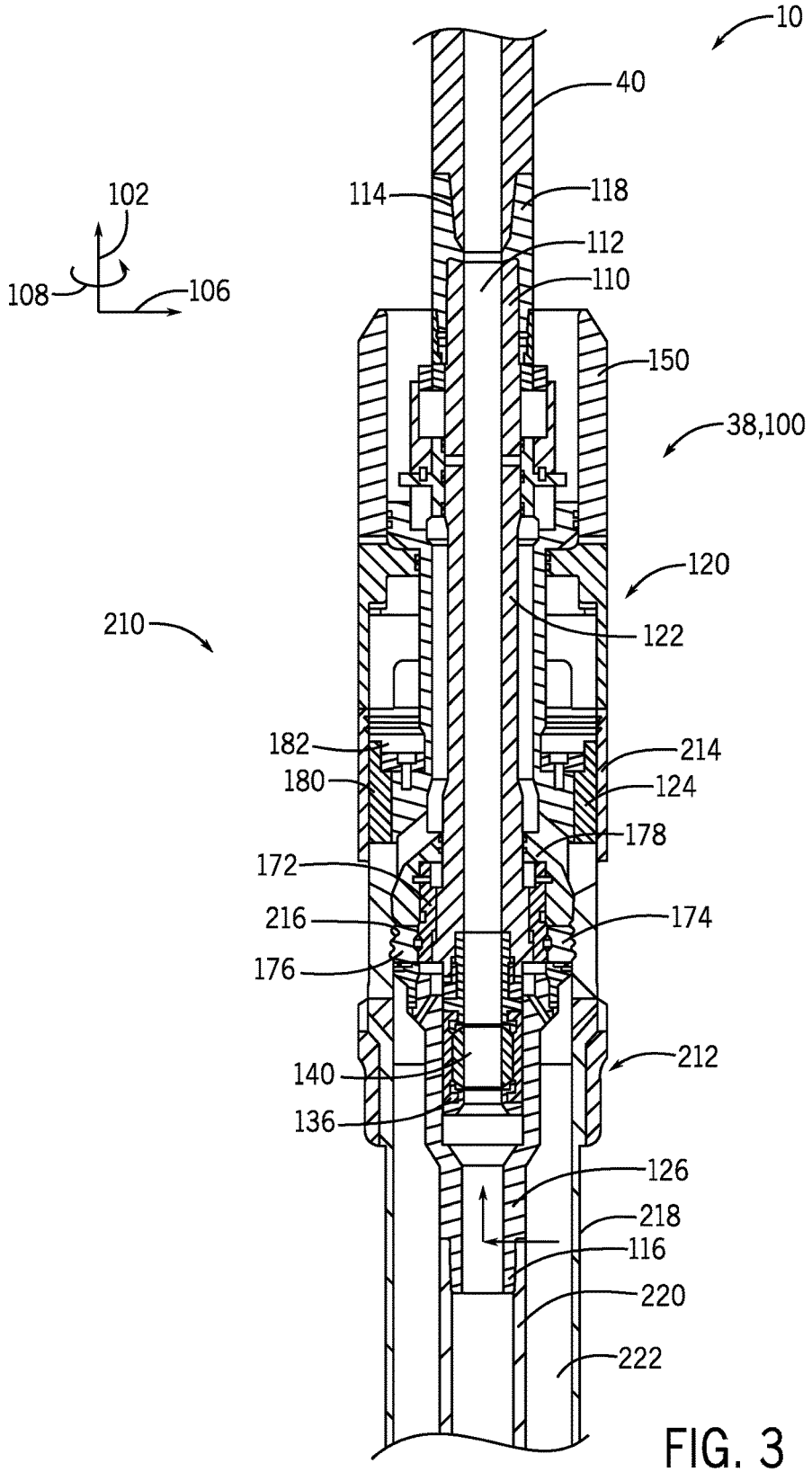
FIG. 3 is a cross-sectional view of an embodiment of an installation assembly including the CHSART of FIG. 2, a casing hanger coupled to the CHSART, and a seal assembly coupled to the CHSART during a running process implemented using the CHSART.

FIGS. 3-9 illustrate cross-sectional views of an embodiment of an installation assembly 210 including the CHSART 100, a casing hanger 212, and a seal assembly 214. In particular, FIGS. 3-7 illustrate the installation assembly 210 at various stages of an embodiment of an installation process for the installation assembly 210. For example, FIG. 3 illustrates the installation assembly 210 as the drill string 40 runs (e.g., lowers) the installation assembly 210 from the surface 14 into the wellhead assembly 16 (e.g., into the casing spool 22). As illustrated, the drill string 40 may be coupled to the connector 118 of the CHSART 100.

During the running or lowering process, the casing hanger 212 is coupled to the CHSART 100. Specifically, plunger 178 may retain or hold the cam ring 172 in the first axial position such that the cam ring 172 may urge the dogs 174 radially 106 outward with respect to the mandrel 110 to cause the shoulders 176 of the dogs 174 to engage or mate with shoulders 216 (e.g., complementary or mating shoulders) of the casing hanger 212. As will be appreciated, the casing hanger 212 may be secured to the CHSART 100 while the shoulders 176 of the dogs 174 are engaged with the shoulders 216 of the casing hanger 212. Additionally, during the running process, the flow control members 140 of the valve 136 may be in the open position. (e.g., a parallel-bore metal-to-metal (PBM) seal, an annular seal, etc.). Further, the shuttle 150 may be disposed in the first position (e.g., upper position).

Additionally, during the running process, the seal assembly 212 may be coupled to the CHSART 100. In particular, the seal assembly 212 may be coupled to the one or more latching segments 180 of the second body 124 via the one or more retaining lips 182. The seal assembly 212 may include one or more seals (e.g., annular seals), such as metal seals, elastomeric seals, lip seals, and so forth. In certain embodiments, the seal assembly 212 may include a parallel-bore metal-to-metal (PBM) seal.

In some embodiments, the installation assembly 210 may include other components in addition to the CHSART 100, the casing hanger 212, and the seal assembly 214. For example, in some embodiments, the installation assembly 210 may include a casing string 218 coupled to (e.g., suspended from) the casing hanger 212. In certain embodiments, the installation assembly 210 may include a string 220 (e.g., a drill string, a casing string, or a tubing string) coupled to (e.g., suspended from) the second end 116 of the CHSART 100. For example, the string 220 (e.g., an inner string) may be disposed within a bore 222 of the casing string 218. During the running process, the CHSART 100 may be configured to support the weight of the casing hanger 212, as well as any other components coupled to the CHSART 100 (e.g., the string 220) and/or any components coupled to the casing hanger 212 (e.g., the casing string 218).

Figure 4:
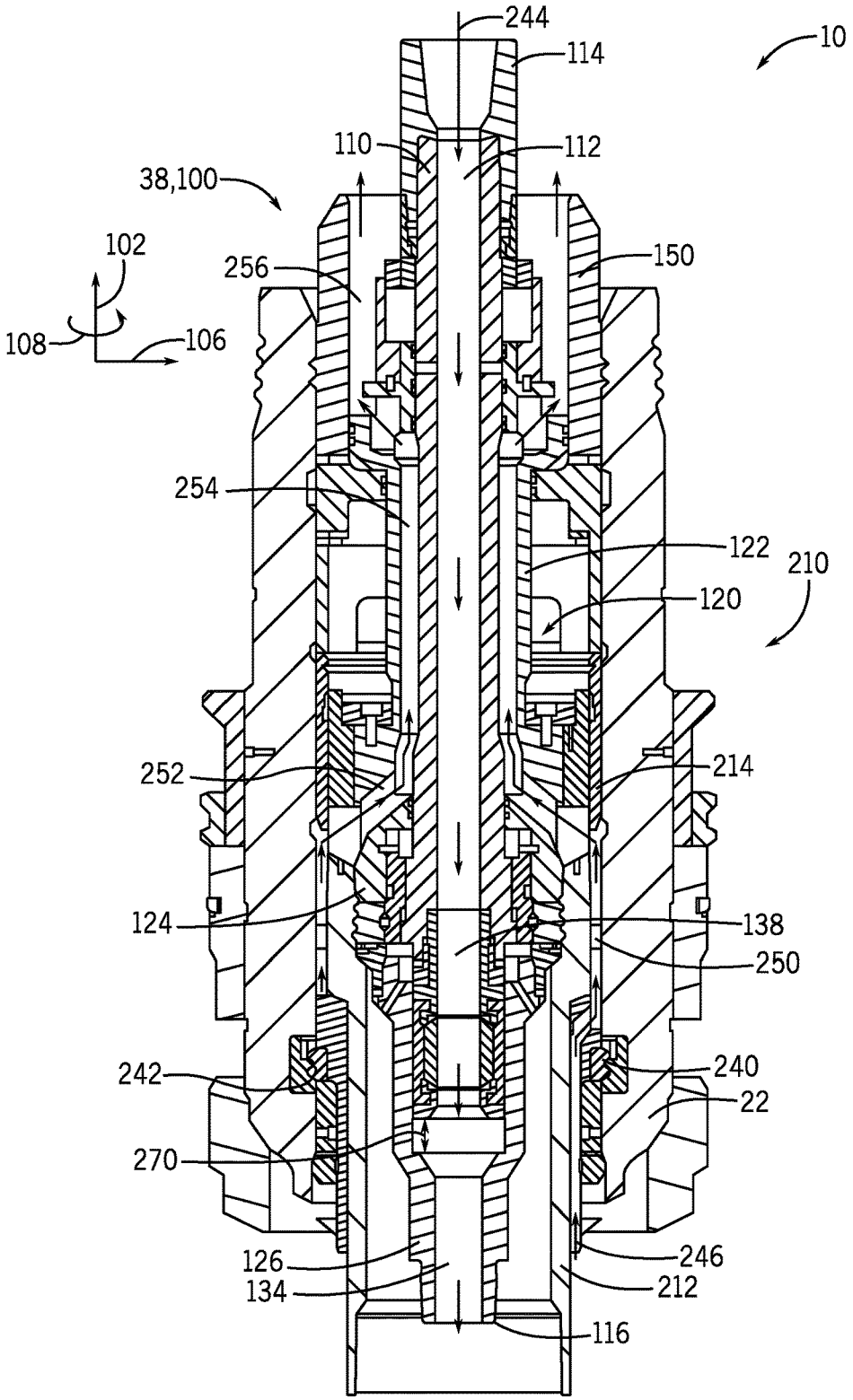
FIG. 4 is a cross-sectional view of the installation assembly of FIG. 3 during a cementing process implementing using the CHSART.

Once the installation assembly 210 has been lowered to a desired position relative to the wellhead assembly 16, the installation assembly 210 may be landed in the wellhead assembly 16. For example, as illustrated in FIG. 4, the installation assembly 210 may be landed in the casing spool 22 (e.g., wellhead housing, high pressure wellhead housing, etc.). In should be noted that in order to simplify FIGS. 4-9, various components of the mineral extraction system 10, such as the drill string 40, the casing string 218, the string 220, and other components of the wellhead assembly 16 have been omitted. In some embodiments, one or more shoulders 240 (e.g., landing shoulders, grooves, protrusions, etc.) of the casing hanger 212 may engage one or more mating shoulders 242 of the casing spool 22 when the installation assembly 210 is landed in the casing spool 22. The shoulders 240 of the casing hanger 212 may transfer the weight of the casing hanger 212 and the casing string 218 coupled to (e.g., suspended from) the casing hanger 212 to the casing spool 22.

After the casing hanger 212 has landed in the casing spool 22, cementing operations may be carried out to cement the casing string 218 suspended by the casing hanger 212. For example, as indicated by arrows 244, cement may flow through the bore 112 of the mandrel 110, through the open valve bore 138, and through the 134 of the third body 126 of the CHSART 100. After the cement exits the second end 116 of the CHSART 100, the cement may flow through the casing string 218 and/or the string 220 to cement the casing string 218 and/or the string 220 into place in the wellhead assembly 16. As indicated by arrows 246, cement returns may flow through a flow passage 248 (e.g., annular passage, opening, etc.) in the casing hanger 212, through an annulus 250 between the casing hanger 212 and the casing spool 22, and through a plurality of flow passages (e.g., annular passages, openings, etc.) of the tool body 120 and the shuttle 150. For example, the cement returns may flow through a flow passage 252 of the second body 124, a flow passage 254 of the first body 122, and a flow passage 256 of the shuttle 150.

Figure 5:
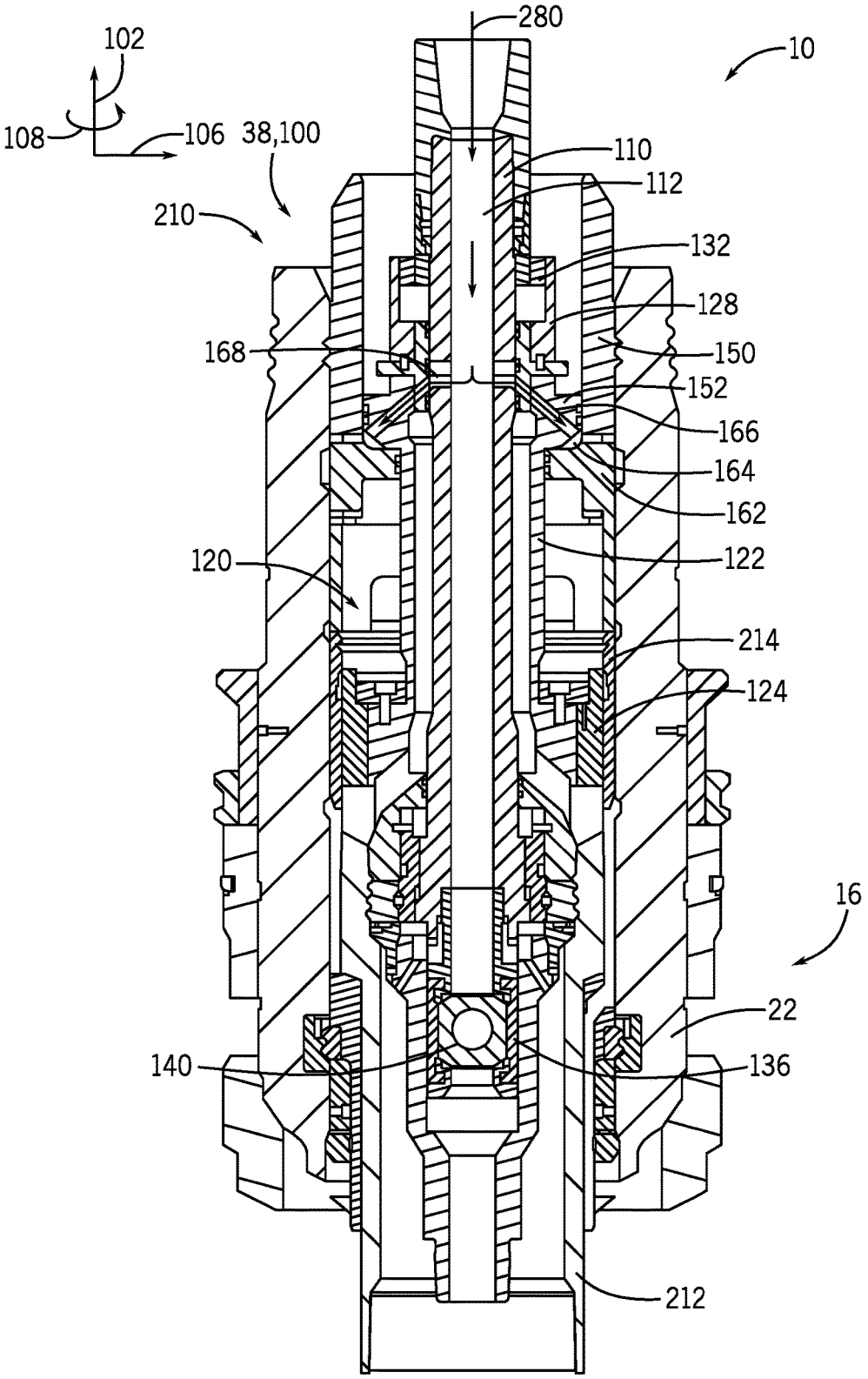
FIG. 5 is a cross-sectional view of the installation assembly of FIG. 3 during a process for setting the seal assembly using the CHSART and illustrating a shuttle of the CHSART in a first position.

After cementing is complete, the flow control member 140 of the valve 136 may be actuated to the closed position as illustrated in FIG. 5. In certain embodiments, the flow control member 140 may be actuated to the closed position in response to circumferential 108 and/or axial 102 movement of the mandrel 110 relative to the tool body 120. In some embodiments, the mandrel 110 may be rotated circumferentially 108 (e.g., a quarter rotation, 90 degrees), and the rotation of the mandrel 110 may enable the mandrel 110 to translate in the axial 102 direction relative to the tool body 120. For example, as discussed above in FIG. 2, in some embodiments, rotation of the mandrel 110 may shear one or more fasteners 132 (e.g., shear pins) coupling the mandrel 110 to the collar 128, which may enable the mandrel 110 to move in the axial direction 102 relative to the collar 128, the shuttle 150, and the tool body 120. In certain embodiments, the one or more fasteners 132 may shear when the torque applied to the mandrel 110 is above a threshold. In some embodiments, weight may be set on the mandrel 110 (e.g., via the drill string 40) to facilitate axial 102 translation of the mandrel 110 to a desired distance. In some embodiments, the mandrel 110 may be translated in the axial 102 direction without rotating the mandrel 110. For example, the weight set on the mandrel 110 may shear the fasteners 132 of the collar 128.

In response to the rotation of the mandrel 110 and/or the weight set on the mandrel 110, the mandrel 110 may move down by a distance 270 (see FIG. 4) relative to the tool body 120 to a second position. In certain embodiments, the valve 136 may also move down by the distance 270. Further, the axial 102 translation of the mandrel 110 into the second position may align the mandrel port 168 (e.g., a radial 106 port) with the piston port 166.

After the mandrel 110 is moved into the second position (e.g., the flow control member 140 is closed and the mandrel port 168 and the piston port 166 are aligned), the CHSART 100 may hydraulically set the seal assembly 214 between the casing hanger 212 and the casing spool 22. Specifically, as illustrated by arrows 280, fluid (e.g., pressurized drilling fluid) from the drill string 40 may flow through the bore 112 of the mandrel 112, through the mandrel port 168 of the mandrel, through the piston port 166, and into the piston chamber 164. As discussed above in FIG. 2, the fluid in the piston chamber 164 may apply a force on the shoulder 162 of the shuttle 150, which may cause the shuttle to translate in the axial direction 102 toward the second body 124.

For example, as illustrated in FIG. 6, the hydraulic pressure applied to the shoulder 162 may cause the shuttle 150 to move down a distance 286 into a second position (e.g., a lower position). In certain embodiments, the axial 102 movement of the shuttle 150 may shear (e.g., break, distort, etc.) the pins 170 (e.g., frangible pins, shear pins, indicator pins, radial 106 pins, etc.) disposed in the shuttle 150. For example, in some embodiments, the axial 102 movement of the shuttle 150 to the second position may cause the one or more pins 170 to contact the flange 186 and/or the tensile bolts 184, which may shear, break, or distort the pins 170.

Further, in certain embodiments, the lower body 124 of the CHSART 100 may include one or more tensile bolts 266 disposed in one or more holes 268 (e.g., axial 102 holes) formed in the lower body 124. In certain embodiments, a collar 270 (e.g., anchor plate) may be disposed on the lower body 124 and may be configured to support a nut 272 (e.g., a washer) coupled to the bolt 266. In some embodiments, the axial 102 movement of the shuttle 150 to the lowered position may cause the shear pin 262 to contact the flange 186, which may shear, break, or distort the shear pin 262. Further, in certain embodiments, the axial 102 movement of the shuttle 150 to the lowered position may cause the shuttle 150 to contact the tensile bolts 266, which may shear, break, or distort the tensile bolts 266.

Further, as the shuttle 150 moves down to the second position, the shuttle 150 may urge the latching segments 180 radially 106 inward toward the mandrel 110 and may urge the seal assembly 214 axially 102 down into sealing position between the casing hanger 212 and the casing spool 22. In some embodiments, the shuttle 150 and/or the pins 170 may break or distort the tensile bolts 184 as the shuttle 150 moves into the second position, which may enable the latching segments 170 to move radially 106 inward toward the mandrel 110. Further, the force applied to the seal assembly 214 by the shuttle 150 (e.g., by a lower end 288 of the shuttle 150) may set the seal assembly 214. For example, the shuttle 150 may cause the seal assembly 214 to expand in the radial direction 106 into sealing position between the casing hanger 212 and the casing spool 22. In some embodiments, once the seal assembly 214 is set and locked into sealing position between the casing hanger 212 and the casing spool 22, the pressure of the fluid in the piston chamber 164 may increase (e.g., spike or momentarily increase).

The CHSART 100 may also be configured to pressure test the seal assembly 214. For example, the middle pipe rams of the BOP 36 (see FIG. 1) may be closed to apply hydraulic pressure to the annulus 250 between the casing hanger 212 and the casing spool 22 and to the seal assembly 214 disposed in the annulus 250. In particular, as illustrated by arrows 290 of FIG. 7, fluid (e.g., high pressure fluid) may be routed to choke or kill lines of the CHSART 100, such as the flow passage 256 of the shuttle 150, the flow passage 254 of the first body 122, and the flow passage 252 of the second body 124, to apply pressure on the seal assembly 214, as illustrated by arrows 292. In the event that the seal assembly 214 is not properly set, fluid may leak past the seal assembly 214 and may flow back up the central bore 112 of the mandrel 110 through ports in the valve 136 fitted with one-way check valves (not shown). The fluid in the annulus 250 may also apply pressure to the lower end 288 of the shuttle 150, as illustrated by arrows 294, to move the shuttle 150 in the axial direction 102 back to the first position.

Figure 8:
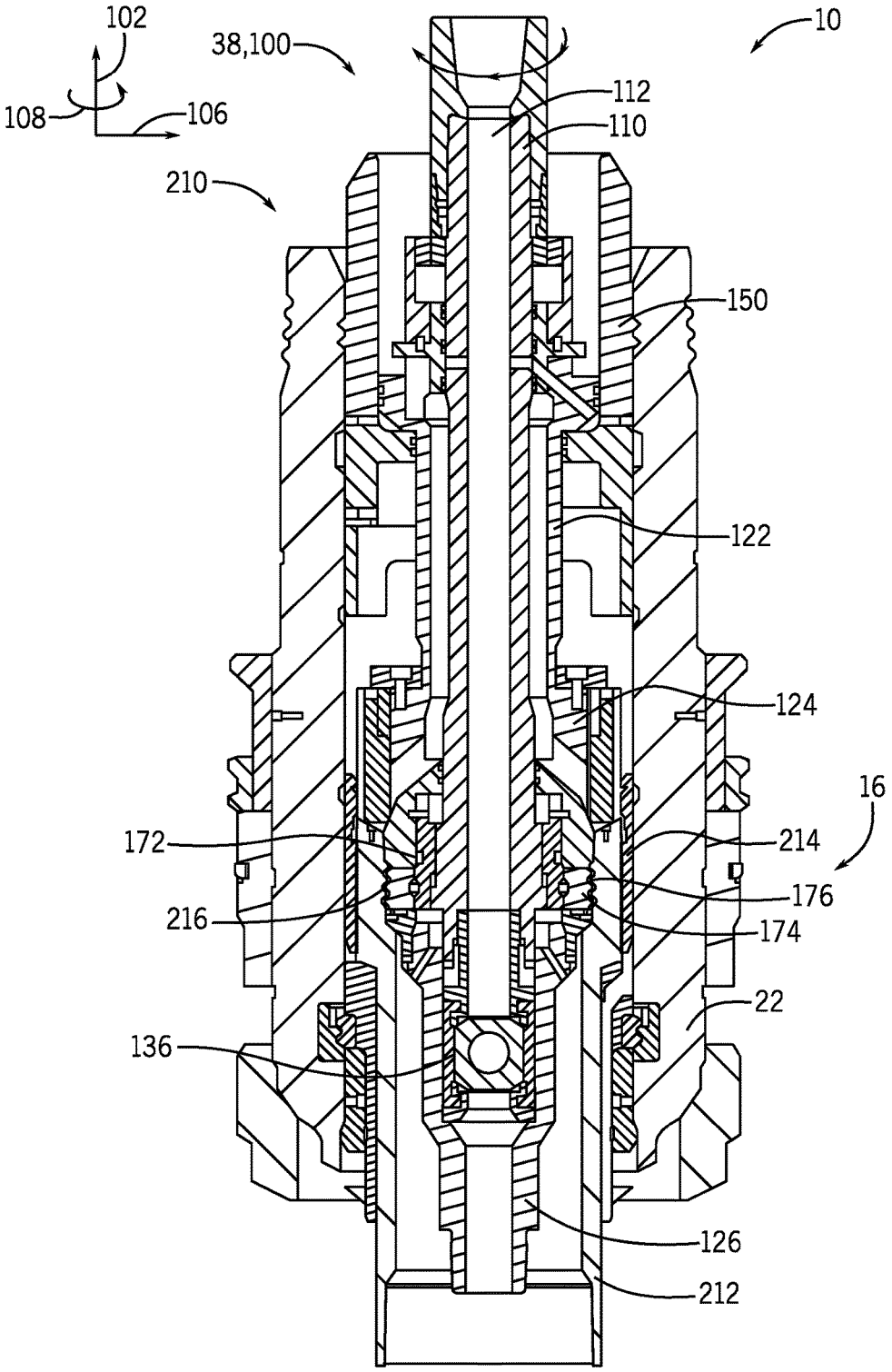
FIG. 8 is a cross-sectional view of the installation assembly of FIG. 3 during a process for uncoupling the CHSART from the casing hanger.
Figure 9:
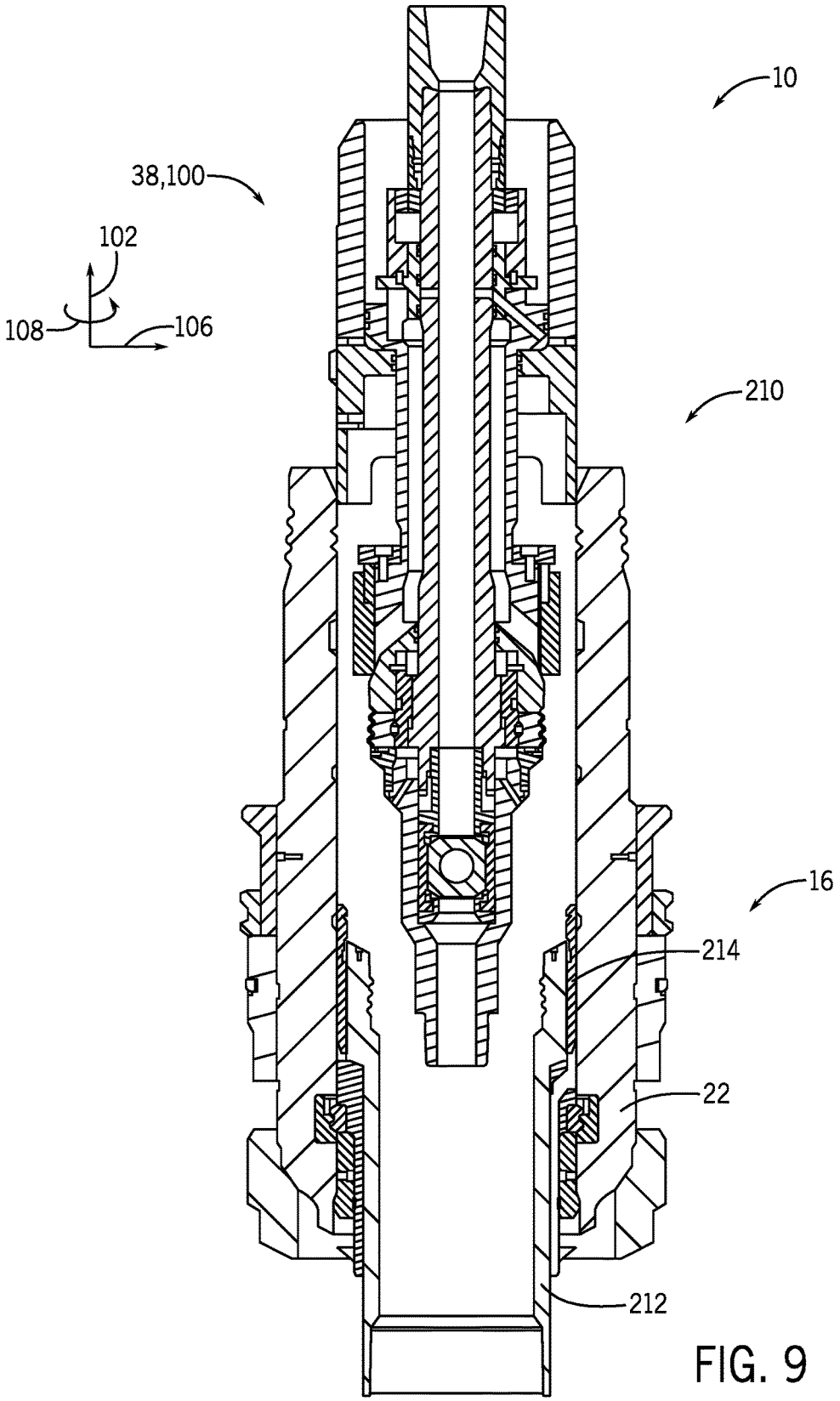
FIG. 9 is a cross-sectional view of the installation assembly of FIG. 3 during a process for raising the CHSART to the surface.

Once pressure testing of the seal assembly 214 is completed, the CHSART 100 may be removed. For example, as illustrated in FIG. 8, the mandrel 110 may be rotated to move the cam ring 172 down in the axial direction 102 relative to the dogs 174. In some embodiments, four rotations (e.g., approximately four 360 degree rotations or approximately 1,440 degrees) of the mandrel 110 may cause the cam ring 172 to move down to the second axial 102 position. As discussed above in FIG. 2, when the cam ring 172 is in the second axial 102 position, the dogs 174 may move radially 106 inward (e.g., retract) toward the mandrel 110 to a second radial 106 position such that the shoulders 176 of the dogs 174 release from the shoulders 216 of the casing hanger 212. In this manner, the circumferential 108 movement of the mandrel 110 may uncouple (e.g., remove, disengage, etc.) the CHSART 100 from the casing hanger 212. Once the CHSART 100 is no longer coupled to the casing hanger 212, the CHSART 100 may raised from the casing spool 22, as illustrated in FIG. 9, and brought to the surface 14.

Figure 10:
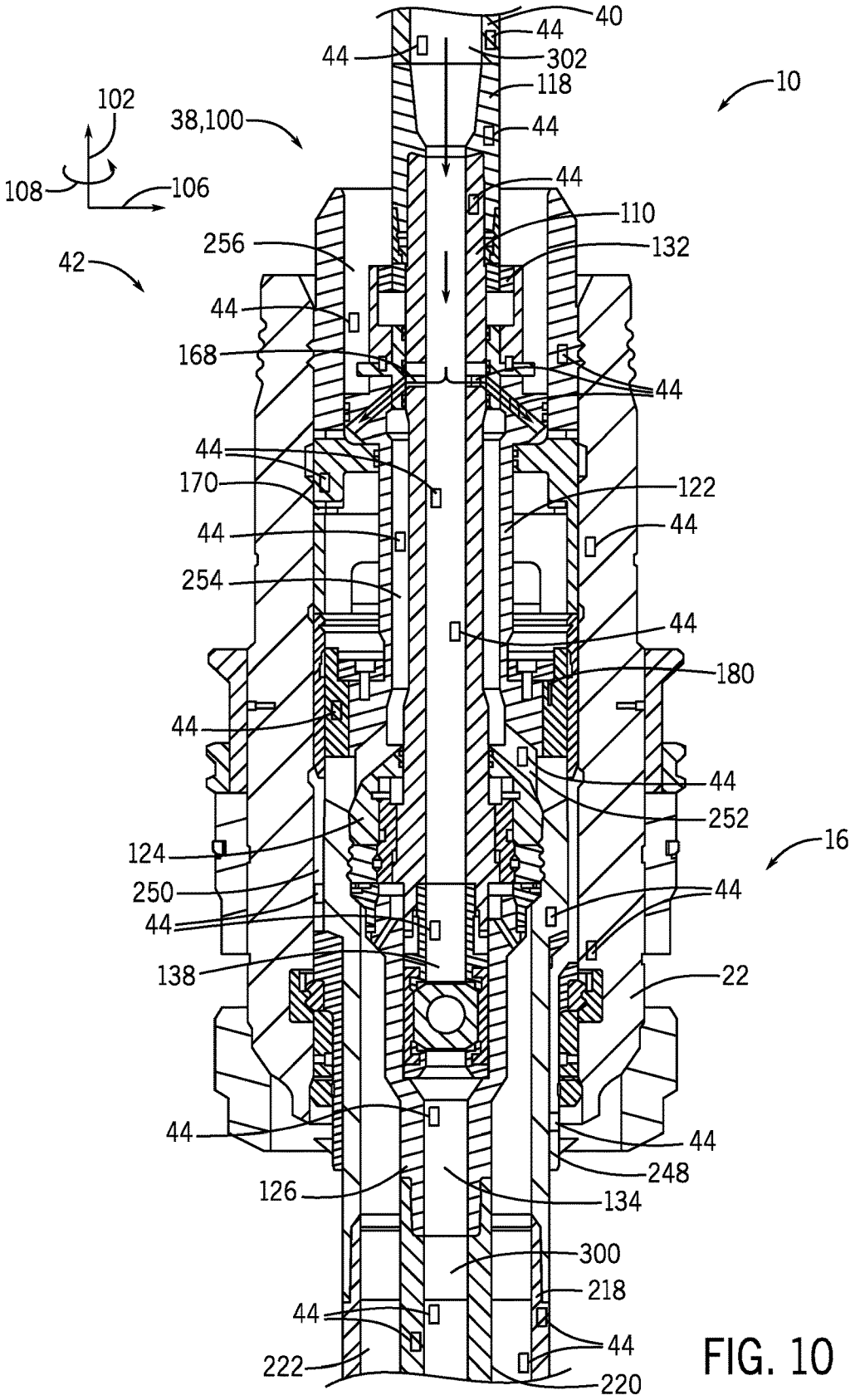
FIG. 10 is a cross-sectional view of an embodiment of the mineral extraction system including the CHSART disposed in a wellhead assembly and a plurality of sensors disposed in the CHSART and the wellhead assembly.

FIG. 10 is a cross-sectional view of an embodiment of the mineral extraction system 10 including the CHSART 100, the casing hanger 212, the seal assembly 214, the casing spool 22, the casing string 218, the string 220, the drill pipe 40, and the plurality of sensors 44. As discussed below, the sensors 44 may be configured to generate feedback relating to the CHSART 100 and/or an installation process implemented using the CHSART 100. The sensors 44 may be disposed in any suitable position about the mineral extraction system 10. For example, one or more sensors 44 may be disposed in or on the casing spool 22, the casing hanger 212, the casing string 218, the string 220, and/or the drill pipe 40. Further, one or more sensors 44 may be disposed in any suitable position about the CHSART 100. For example, in some embodiments, one or more sensors 44 may be disposed in or on the mandrel 110, the connector 118, the tool body 120 (e.g., the first body 122, the second body 124, and/or the third body 126), and/or the shuttle 150. In certain embodiments, one or more sensors may be disposed in one or more bores, flow passages, annuluses, etc. of the mineral extraction system 10. For example, one or more sensors 44 may be disposed in one or more bores, flow passages, annuluses, etc. of the CHSART 100, such as the central bore 112, the valve bore 138, the bore 134, the mandrel port 168, the piston port 166, the piston chamber 164, and/or the flow passages 252, 254, and 256. In some embodiments, one or more sensors 44 may be disposed in the flow passage 248 in the casing hanger 212 and/or in annulus 250 between the casing hanger 212 and the casing spool 22. In certain embodiments, one or more sensors 44 may be disposed in the bore 222 of the casing string 218, a bore 300 of the string 220, and/or a bore 302 of the drill pipe 40.

Figure 11:
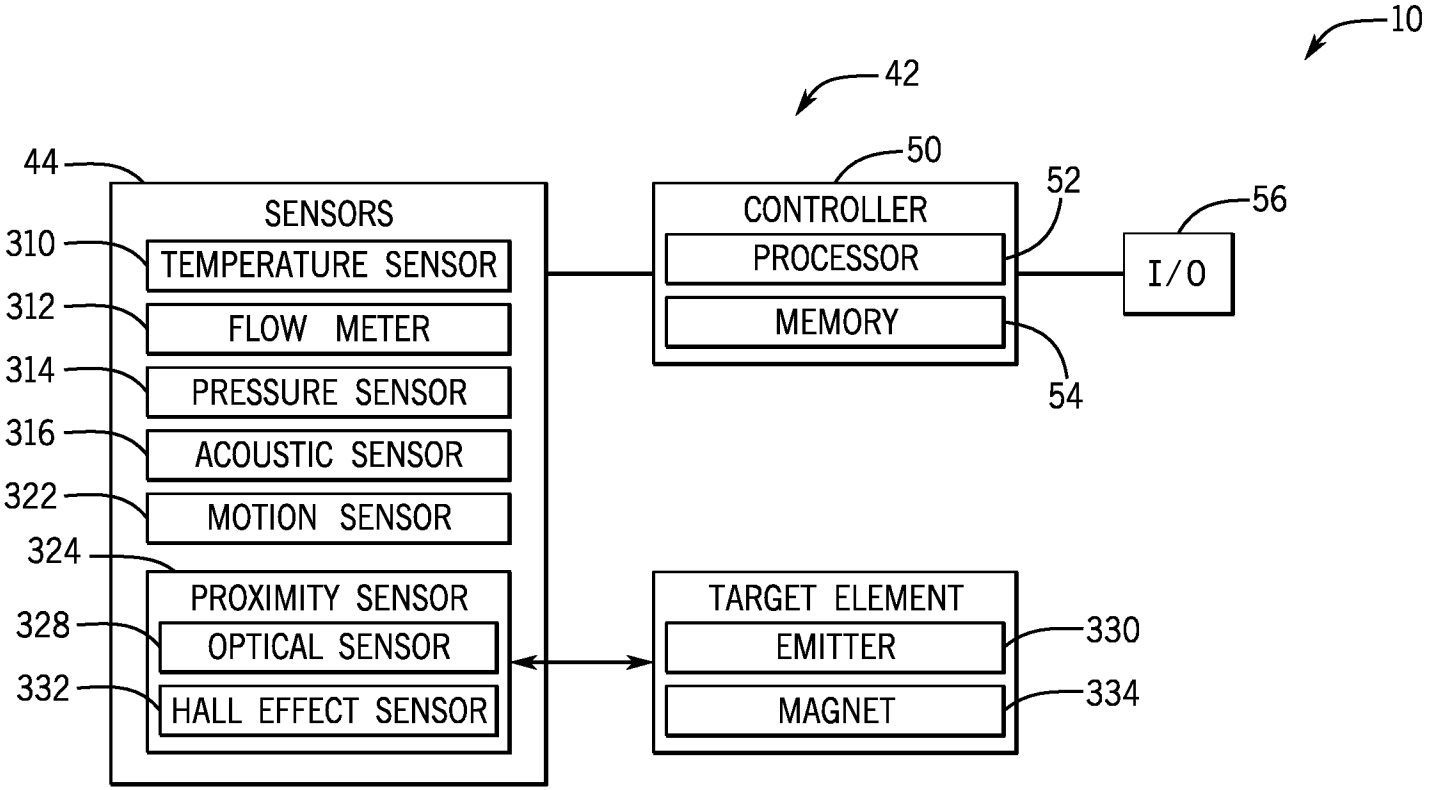
FIG. 11 is a block diagram of an embodiment of the control system of FIG. 1 including a controller, an input/output device, and a plurality of sensors.

FIG. 11 illustrates a block diagram of an embodiment of the control system 42 including the plurality of sensors 44, the controller 50, and the I/O device 56. As illustrated, the plurality of sensors 44 may include one or more temperature sensors 310 configured to measure temperature, one or more flow meters 312 configured to measure flow rate, and one or more pressure sensors 314 configured to measure pressure. In some embodiments, the temperature sensors 310, flow meters 312, and pressure sensors 314 may be configured to measure the temperature, flow rate, and pressure, respectively, of various fluids (e.g., cement, drilling fluids, etc.) flowing through or around the CHSART 100. The temperature sensors 310, flow meters 312, and pressure sensors 314 may be disposed in the central bore 112, the valve bore 138, the bore 134, the mandrel port 168, the piston port 166, the piston chamber 164, the flow passages 252, 254, and 256 of the CHSART 100, and/or any other bore, flow passage, or annulus of the mineral extraction system 10, such as those described above. As discussed in more detail in FIG. 12, one or more pressure sensors 314 (e.g., load cells, strain gauges, weight sensors, piezoelectric sensors, potentiometers, etc.) may be configured to generate feedback relating to forces applied to the CHSART 100, which may be used to determine the position of the CHSART 100 relative to the surface 14, the position of the CHSART 100 relative to the wellhead assembly 16 (e.g., the casing spool 22), and/or the position of various components of the CHSART 100, such as the mandrel 110 and the shuttle 150.

In some embodiments, the plurality of sensors 44 may include one or more acoustic sensors 316 configured to detect acoustic waves (e.g., sound). For example, the acoustic sensors 316 may detect acoustic waves generated in response to shearing, breaking, or distorting the one or more fasteners 132 when the mandrel 110 moves in the axial direction 102 and/or the circumferential direction 108 to the second position. In certain embodiments, the one or more acoustic sensors 316 may detect acoustic waves generated by shearing, breaking, or distorting the one or more pins 170 and/or the one or more tensile bolts 184 when the shuttle 150 moves in the axial direction 102 to the second position. In some embodiments, the one or more acoustic sensors 316 may be disposed proximate to the one or more fasteners 132, pins 170, and/or tensile bolts 184. For example, the one or more acoustic sensors 316 may be disposed in the mandrel 110, the shuttle 150, the second body 124, or in any other suitable location.

Further, in some embodiments, the plurality of sensors 44 may include one or more motion sensors 322. The motion sensors 322 may include accelerometers, gyroscopes, inclinometers, or any other suitable sensor configured to measure position, speed, and/or acceleration in the axial direction 102, the radial direction 106, and/or the circumferential direction 108. The motion sensors 322 may be disposed in or on any suitable component of the mineral extraction system 10, such as the CHSART 100 (e.g., the mandrel 110, the connector 118, the shuttle 150, the tool body 120, and so forth), the casing hanger 212, the drill pipe 40, the casing string 218, and/or the string 220, to monitor the position, speed, and/or acceleration of the component in the axial direction 102, the radial direction 106, and/or the circumferential direction 108. For example, the CHSART 100 may include one or more motion sensors 322 in the mandrel 110 and/or the central bore 112 to monitor the position, speed, and/or acceleration of the mandrel 110, which may be used by the controller 50 to determine whether the mandrel 110 is in the first position or the second position. In some embodiments, the CHSART 100 may include one or more motion sensors 322 in the shuttle 150 to monitor the position, speed, and/or acceleration of the shuttle 150, which may be used by the controller 50 to determine whether the shuttle 150 is in the first position or the second position. In some embodiments, an inclinometer disposed in the CHSART 100 (e.g., the tool body 120) may measure the depth or elevation of the CHSART 100 relative to the surface 14.

In certain embodiments, the plurality of sensors 44 may include one or more proximity sensors 324. The one or more proximity sensors 324 may be disposed in any suitable component of the mineral extraction system 10, such as the CHSART 100 (e.g., the mandrel 110, the connector 118, the shuttle 150, the tool body 120, and so forth), the casing hanger 212, the drill pipe 40, the casing string 218, and/or the string 220 to monitor the position of the component relative to a target component (e.g., the proximity of the component relative to the target component). In some embodiments, the one or more proximity sensors 324 may include inductive sensors and/or Eddy current sensors configured to detect proximity to a conductive component, such as a metal component. However, in some embodiments, certain wellhead components (e.g., wellhead housing, the casing spool 22, the tubing spool 24, etc.) may be made from metal. As such, it may be difficult to determine the relative position of the CHSART 100 in the wellhead assembly 16 using inductive sensors and/or Eddy current sensors. In some embodiments, the proximity sensors 324 may include radar sensors, sonar sensors, ultrasonic sensors, Doppler effect sensors, and so forth, which may be configured to emit signals (e.g., radio waves, acoustic waves, ultrasound waves, etc.) and to receive returned signals after the emitted signals have interacted with a target component. The controller 50 may be configured to determine the position, speed, and/or acceleration of a component having the proximity sensor 324 relative to the target component based on an analysis of the emitted signals and the returned signals.

In some embodiments, one or more proximity sensors 324 may generate feedback based on interaction with one or more target elements 326 disposed in a target component. For example, in some embodiments, the one or more proximity sensors 324 may include optical sensors 328 (e.g., photodetectors, electromagnetic radiation detectors, etc.) configured to detect electromagnetic radiation (e.g., light) and the one or more target elements 326 may include one or more emitters 330 (e.g., radiation emitters, light emitters, light emitting diodes, etc.) configured to emit electromagnetic radiation. As discussed below in FIG. 12, the optical sensors 328 and the emitters 330 may be disposed in any suitable position about the CHSART 100, the casing spool 22, or any other suitable component of the mineral extraction system 10, such that light or an increase in light intensity is detected when a component (e.g., the mandrel 100, the shuttle 150, the valve 136, etc.) is in a first position and is not detected when the component is in the second position or vice versa. In this manner, detected light (e.g., the intensity of detected light) or the absence of light may be used to determine the position of the component and/or the movement of the component.

In some embodiments, the one or more proximity sensors 324 may include one or more Hall effect sensors 332 and the one or more target elements 326 may include one or more magnets 334. The Hall effect sensors 332 may generate a variable feedback signal (e.g., variable voltage) based on the proximity of the Hall effect sensors 332 to a magnetic field generated by the magnets 334. As discussed below in FIG. 12, the Hall effect sensors 332 and the magnets 334 may be disposed in any suitable position about the CHSART 100, the casing spool 22, or any other suitable component of the mineral extraction system 10 to determine the position, speed, and/or acceleration of a desired component relative to a target component.

Figure 12:
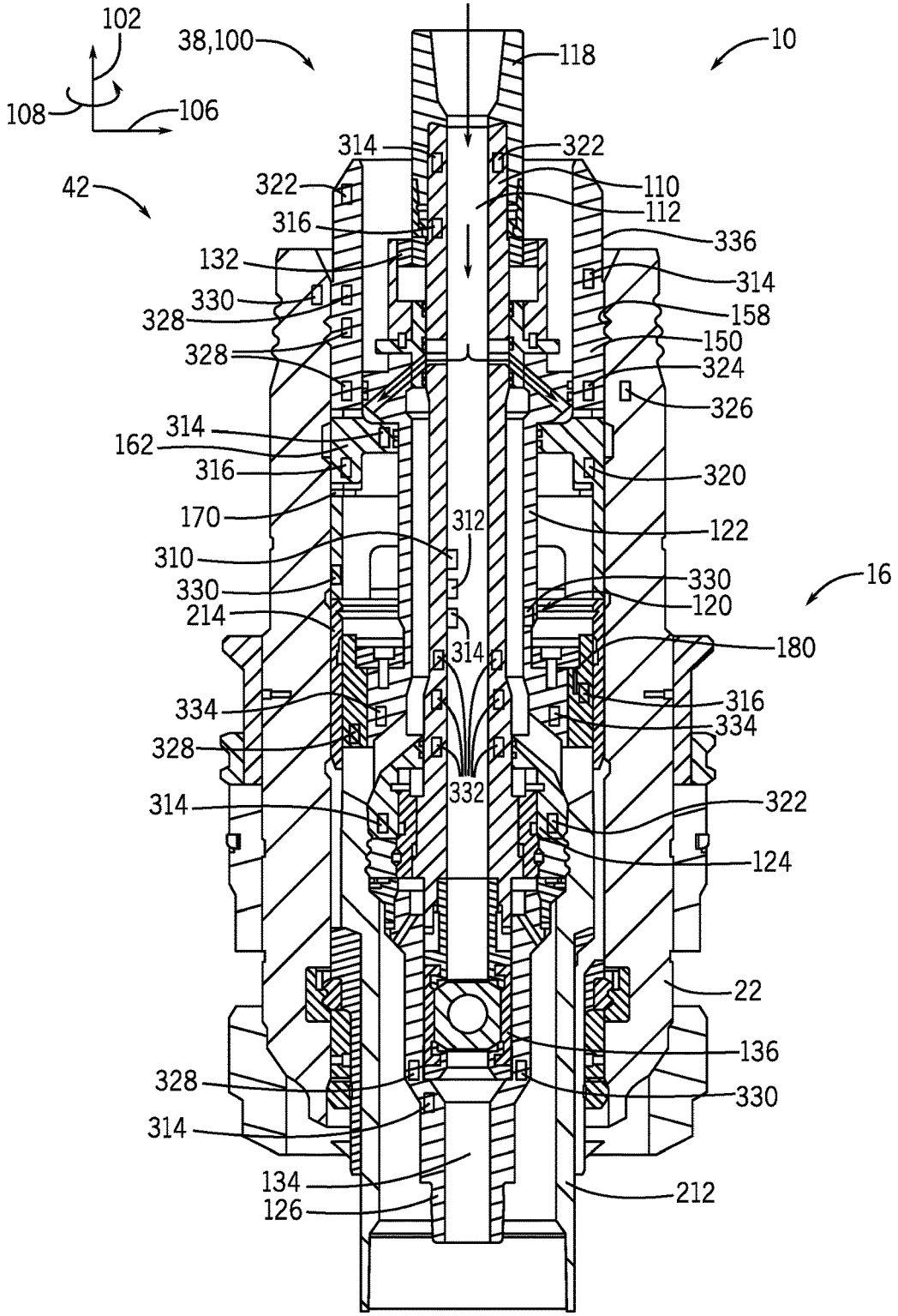
FIG. 12 is a cross-sectional view of an embodiment of the mineral extraction system including the CHSART disposed in a wellhead assembly and a plurality of sensors disposed in the CHSART.

FIG. 12 is a cross-sectional view of an embodiment of the CHSART 100 including the temperature sensors 310, the flow meters 312, the pressure sensors 314, the acoustic sensors 316, the motion sensors 322, and the proximity sensors 324. As illustrated, the CHSART 100 may include a temperature sensor 310, a flow meter 312, and a pressure sensor 314 disposed in the central bore 112 to measure the temperature, flow rate, and pressure, respectively, of fluids flowing through the central bore 112. As noted above, the temperature sensors 310, the flow meters 312, and the pressure sensors 314 may be disposed in any suitable bore, flow passage, and/or annulus of the CHSART 100 and/or of components surrounding the CHSART 100, such as the casing hanger 212 and the casing spool 22. Further, as illustrated, the CHSART 100 may include acoustic sensors 316 disposed in the mandrel 110, the shuttle 150, and the second body 124 to detect acoustic waves caused by shearing, breaking, or distorting the fasteners 132, the pins 170, and the tensile bolts 180. However, as noted above, the acoustic sensors 316 may be disposed in any suitable location of the CHSART 100 or in any other component of the mineral extraction system 10. Additionally, as illustrated, the CHSART 100 may include one or more motion sensors 322 disposed in or on the mandrel 110, the shuttle 150, and/or the tool body 120 to configured to generate feedback relating to the position, speed, and/or acceleration of the mandrel 110, the shuttle 150, and/or the CHSART 100, respectively, in the axial direction 102, the radial direction 106, and/or the circumferential direction 108.

Additionally, as noted above, one or more pressure sensors 314 (e.g., load cells, strain gauges, piezoelectric sensors, potentiometers, etc.) may be configured to generate feedback relating to a position (e.g., depth or elevation) of the CHSART 100 relative to the surface 14 and/or a position (e.g., an axial 102 position) of the CHSART 100 relative to the wellhead assembly 16 (e.g., wellhead housing, the casing spool 22, etc.). For example, one or more pressure sensors 314 may be positioned about the CHSART 100 such that the pressure sensors 314 are exposed to a fluid (e.g., pressurized water) surrounding the CHSART 100 and/or are configured to contact the casing spool 22 when the CHSART 100 is disposed within the casing spool 22. For example, as illustrated, one or more pressure sensors 314 may be disposed in or on an outer surface 336 of the CHSART 100, such as the outer wall 158 of the shuttle 150.

In certain embodiments, one or more pressure sensors 314 may generate feedback relating to a weight carried by the CHSART 100. For example, one or more pressure sensors 314 may be positioned about the mandrel 110, the first body 122, the second body 124, and/or the third body 126 and may generate feedback relating to a weight, stress, and/or strain on the CHSART 100 caused by one or more wellhead components, such as the casing hanger 212 and the casing string 218, suspended by the CHSART 100. In some embodiments, one or more pressure sensors 314 may be disposed in or on the mandrel 110 and/or the connector 118 and may generate feedback relating to a weight set on the mandrel 110.

In certain embodiments, one or more pressure sensors 314 may be disposed in or on the shoulder 162 of the shuttle 150 and may generate feedback relating to the hydraulic pressure applied to the shoulder 162 to translate the shuttle 150. Further, in some embodiments, one or more pressure sensors 314 may be disposed in the third body 126 of the CHSART 100 and/or the bore 134 of the third body 126 and may be configured to generate feedback relating to the axial 102 position of the valve 136 and the mandrel 110. For example, a pressure sensor 314 may be positioned in the third body 126 such that the valve 136 does not apply a pressure to the pressure sensor 314 when the mandrel 110 is in the first axial 102 position and such that the valve 136 applies a pressure to the pressure sensor 314 when the mandrel 110 is in the second axial 102 position.

As noted above, the proximity sensors 324 may include one or more optical sensors 328 that may detect light emitted from one or more emitters 330. In some embodiments, the optical sensors 328 and the emitters 330 may be positioned to determine the position of the CHSART 100 relative to the wellhead assembly 16 (e.g., wellhead housing, the casing spool 22, etc.). For example, as illustrated, an optical sensor 328 disposed in the outer wall 336 of the CHSART 100 (e.g., the wall 158 of the shuttle 150) may detect light emitted from an emitter 330 disposed in the casing spool 22 when the CHSART 100 is properly positioned within the casing spool 22 for landing. As illustrated, in some embodiments, the CHSART 100 may include a plurality of optical sensors 328 disposed along an axial 102 length of the wall 158 of the shuttle 150 (e.g., axially 102 arranged). In this manner, the controller 50 may use the light detected by the plurality of optical sensors 328 to determine multiple positions of the CHSART 100 and to monitor the position and movement of the CHSART 100 relative to the casing spool 22 during the running process.

In certain embodiments, the optical sensors 328 may generate feedback relating to the axial 102 position and/or the circumferential 108 position of one or more components of the CHSART 100, such as the mandrel 110, the shuttle 150, the valve 136, and so forth. For example, as illustrated, an optical sensor 328 and an emitter 330 may be disposed about the third body 124 such that the optical sensor 328 detects light from the emitter 330 when the mandrel 110 is in the first position and such that light to the optical sensor 328 is blocked by the valve 136 when the mandrel 110 is in the second position. As illustrated, in some embodiments, an optical sensor 328 may be disposed in the first body 122 and an emitter 330 may be disposed in the shuttle 150 such that the optical sensor 328 detects light or an increase in light intensity from the emitter 330 when the shuttle 150 is in the second position. As illustrated, in certain embodiments, an optical sensor 328 may be disposed in the second body 124 and an emitter 330 may be disposed in the shuttle 150 (e.g., a lower portion of the shuttle 150) such that the optical sensor 328 detects light when the shuttle 150 is in the second position and such that the seal assembly 214 blocks the optical sensor 328 from light when the shuttle 150 is in the first position. It should be appreciated that the position of the optical sensors 328 and the emitters 330 may be switched in some embodiments.

Further, as noted above, the proximity sensors 324 may include one or more Hall effect sensors 332 that may generate variable feedback signals based on the proximity or position of the Hall effect sensors 332 to a magnetic field generated by one or more magnets 334. In some embodiments, the Hall effect sensors 332 and the magnets 334 may be positioned to determine the position, speed, and/or acceleration of the mandrel 110 relative to the tool body 120, the shuttle 150, and/or the casing spool 22. For example, the CHSART 100 may include one or more Hall effect sensors 332 disposed in or on the mandrel 110, and one or more magnets 334 may be disposed in the tool body 120 (e.g., the first body 122 or the second body 124), the shuttle 150, and/or the casing spool 22. As illustrated, in some embodiments, the CHSART 100 may include a plurality of Hall effect sensors 332 disposed along an axial 102 length of the mandrel 110 (e.g., axially 102 arranged) and a plurality of magnets 332 disposed in the second body 124 in a circumferential 108 arrangement. In some embodiments, the Hall effect sensors 332 may be axially 102 and circumferentially 108 arranged about the mandrel 110.

In certain embodiments, the Hall effect sensors 332 and the magnets 334 may be positioned to determine the position, speed, and/or acceleration of the shuttle 150 relative to the tool body 120, the mandrel 110, and/or the casing spool 22. For example, the CHSART 100 may include one or more Hall effect sensors 332 disposed in or on the shuttle 150, and one or more magnets 334 may be disposed in the tool body 120 (e.g., the first body 122 or the second body 124), the mandrel 110, and/or the casing spool 22. In certain embodiments, the Hall effect sensors 332 and the magnets 334 may be positioned to determine the position, speed, and/or acceleration of the CHSART 100 relative to the casing spool 22. For example, the CHSART 100 may include one or more Hall effect sensors 332 disposed in or on the shuttle 150, the tool body 120, and/or the mandrel 110, and the casing spool 22 may include one or more magnets 334. It should be appreciated that the position of the Hall effect sensors 332 and the magnets 334 may be switched in some embodiments.

Figure 13:
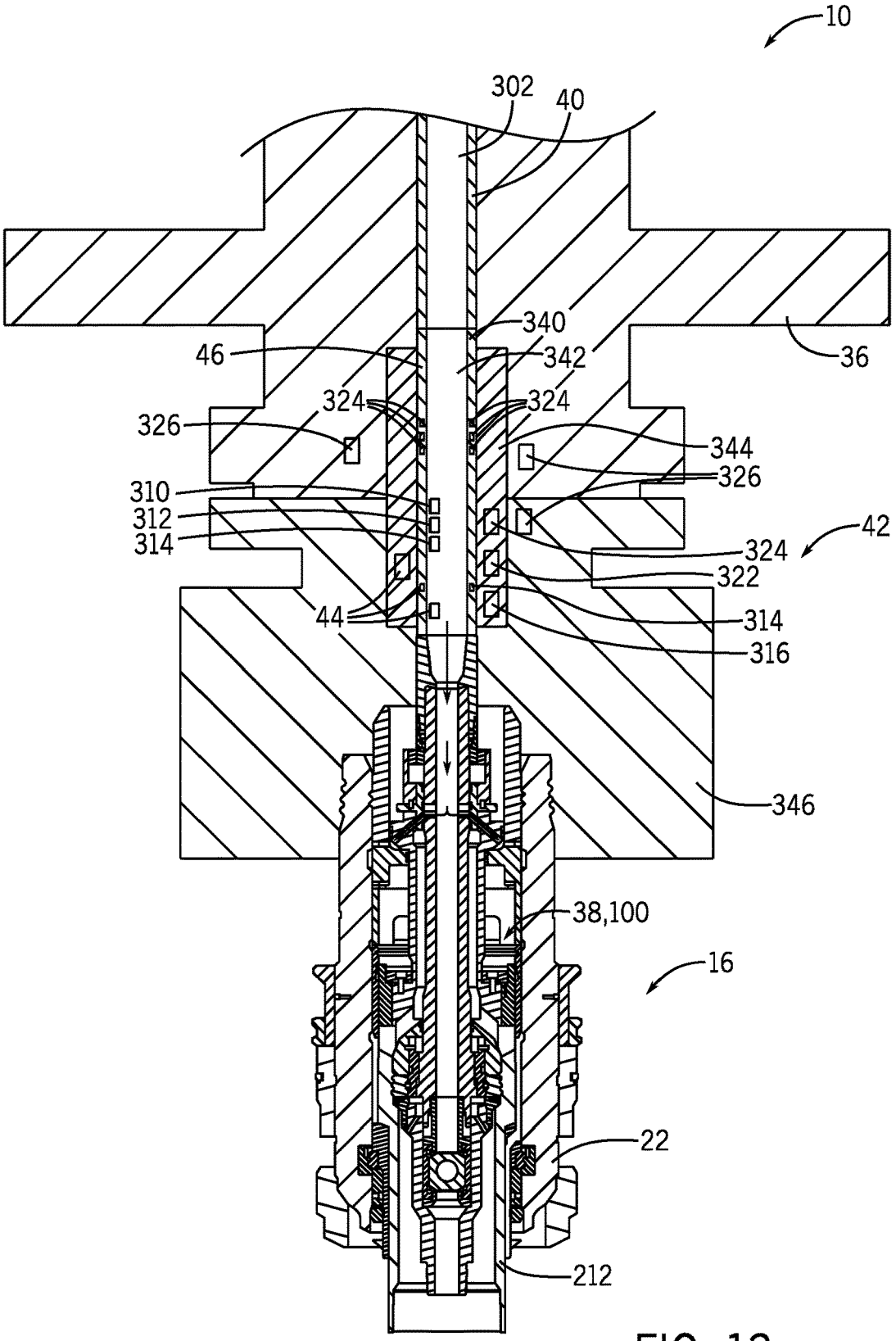
FIG. 13 is a cross-sectional view of an embodiment of the mineral extraction system including the CHSART, a module disposed above the CHSART, and a plurality of sensors disposed in the module.

FIG. 13 illustrates a cross-sectional view of an embodiment of the module 46 (e.g., a running tool module, a sensor module, etc.) including the sensors 44. As illustrated, the module 46 is coupled to the drill string 40 and is disposed above the CHSART 100. While the CHSART 100 does not include the sensors 44 in the illustrated embodiments, it should be appreciated that in some embodiments, the sensors 44 may be disposed in the module 46, the CHSART 100, and any other suitable components of the mineral extraction system 10.

In some embodiments, the module 46 may include a mandrel 340 (e.g., a stem, a tubular body, a cylindrical body, etc.) disposed circumferentially 108 about the drill string 40. The module 46 may also include a bore 342 extending through the mandrel 340. The bore 342 may be coaxial with the bore 302 of the drill string 40. In certain embodiments, the module 46 may also include a body 344 disposed about (e.g., carried by) the mandrel 340. As illustrated, the module 46 may include sensors 44 disposed in or on the mandrel 340, the bore 302, and/or the body 344.

In some embodiments, the module 46 may include one or more temperature sensors 314, one or more flow meters 312, and/or one or more pressure sensors 314 disposed in the bore 342 to monitor the temperature, flow rate, and/or pressure, respectively, of fluids flowing through the bore 342. In some embodiments, the module 46 may include one or more pressure sensors 314 disposed in the mandrel 340 and/or the body 344 to measure forces applied to the module 46 (e.g., weight carried by the module 46, the drill string 40, and the CHSART 100 and/or a weight set on the module 46, the drill string 40, and the CHSART 100). Additionally, the module 46 may include one or more acoustic sensors 316, which may detect acoustic waves caused by shearing or breaking the fasteners 132, the pins 170, and/or the tensile bolts 180 of the CHSART 100. Further, the module 46 may include one or more motion sensors 322 to generate feedback relating to the position, speed, and/or acceleration of the module 46 in the axial direction 102, the radial direction 106, and/or the circumferential direction 108.

Further, the module 46 may include one or more proximity sensors 324. In some embodiments, the proximity sensors 324 (e.g., optical sensors 328, Hall effect sensors 332, etc.) may generate feedback based on interactions with the target elements 326 (emitters 330, magnets 334, etc.), as discussed above. In some embodiments, one or more target elements 326 may be disposed in one or more wellhead components surrounding the module 46, such as the BOP 36 and a wellhead connector 346. It should be appreciated that the proximity sensors 324 and the target elements 326 may be disposed in any suitable arrangement in the module 46, the BOP 36, and/or the wellhead connector 346 to monitor the position, speed, and/or acceleration of the module 46 in the axial direction 102, the radial direction 106, and/or the circumferential direction 108 relative to the BOP 36 and/or the wellhead connector 346. For example, in certain embodiments, the module 46 may include a plurality of proximity sensors 324 (e.g., optical sensors 328 and/or Hall effect sensors 332) in an axial 102 and/or circumferential 108 arrangement, and the BOP 36 and/or the wellhead connector 346 may include a plurality of target elements 326 (e.g., emitters 330 and/or magnets 334) in an axial 102 and/or circumferential 108 arrangement.

Figure 14:
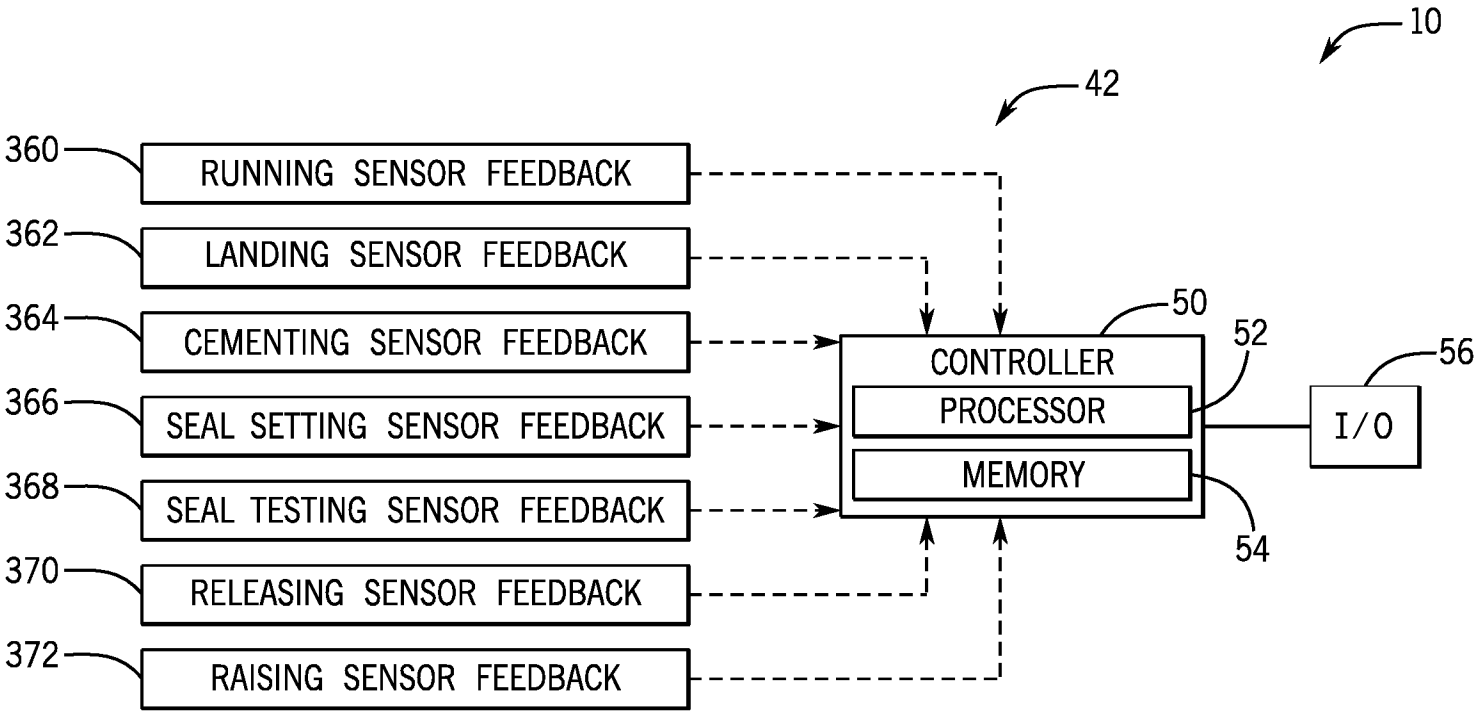
FIG. 14 is a block diagram of an embodiment of the control system of FIG. 1 including a controller and an input/output device.

FIG. 14 illustrates a block diagram of an embodiment of the control system 42, which may be configured to monitor a running tool 38, such as the CHSART 100, and/or an installation process implemented using a running tool 38, such as the CHSART 100. The control system 42 may include the controller 50 having the processor 52 and the memory 54. Additionally, the control system 42 may include the input/output (I/O) device 56 that is communicatively coupled to the controller 50. The controller 50 may receive feedback (e.g., data, signals, etc.) generated by the sensors 44, such as the temperature sensors 310, the flow meters 312, the pressure sensors 314, the motion sensors 322, the proximity sensors 324, the optical sensors 328, and/or the Hall effect sensors 332. Additionally, the controller 50 may cause the I/O device 56 to provide one or more indications (e.g., user-perceivable indications, visual indications, and/or audible indications) based on the feedback. As discussed below, the controller 50 may receive running sensor feedback 360, landing sensor feedback 362, cementing sensor feedback 364, seal setting sensor feedback 366, seal testing sensor feedback 368, releasing sensor feedback 370, and/or raising sensor feedback 372 from the plurality of sensors 44.

The running sensor feedback 360 may include feedback relating to the running (e.g., lowering) of one or more wellhead components (e.g., the casing hanger 212, the casing string 218, the string 220, a tubing hanger, a tubing string, etc.) into a wellhead assembly 16 (e.g., wellhead housing, the casing spool 22, the tubing spool 24, etc.) using a running tool 38 (e.g., the CHSART 100). For example, the running sensor feedback 340 may include feedback relating to the position (e.g., elevation, depth, axial position) of the running tool 38 relative to the surface 14 and/or relative to the wellhead assembly 16 (e.g., wellhead housing, the casing spool 22, the tubing spool 24, etc.). In certain embodiments, the controller 50 may determine the position (e.g., a real-time or substantially real-time position) of the running tool 38 relative to the surface 14 and/or the wellhead assembly 16 based on the running sensor feedback 360.

Further, in some embodiments, the controller 50 may cause the I/O device 56 to provide one or more indications indicative of the position of the running tool 38 relative to the surface 14 and/or the wellhead assembly 16, which may facilitate an operator in determining when the running tool 38 has been lowered to a desired position. For example, the I/O device 56 may display a numerical value of the depth of the running tool 38 (e.g., relative to the surface 14) and a numerical value of the desired depth of the running tool 38. In some embodiments, the I/O device 56 may display a graphical indication of a real-time or substantially real-time position of the running tool 38 and the one or more wellhead components suspended by the running tool 38 relative to the wellhead assembly 16 (e.g., the casing spool 22, the tubing spool 24, wellhead housing, etc.). In some embodiments, the controller 50 may compare the position of the running tool 38 to a threshold (e.g., a maximum depth), may determine a remaining distance to be travelled by the running tool 38 until the running tool 38 reaches a desired position based on the comparison, and may cause the I/O device 56 to display the remaining distance. In certain embodiments, the controller 50 may cause the I/O device 56 to provide a first indication (e.g., an alert) when the position of the running tool 38 approaches (e.g., ±25% or ±10% of) the threshold, a second indication (e.g., an alert) when the position of the running tool 38 reaches the threshold, and/or a third indication (e.g., an alarm) when the position of the running tool 38 exceeds the threshold. It should be appreciated that in addition to or instead of the running tool 38 position feedback, the running sensor feedback 360 may include feedback relating to the position of the one or more wellhead components suspended by the running tool 38. Similarly, the controller 50 may additionally or alternatively determine the position of the one or more wellhead components suspended by the running tool 38 and may cause the I/O device 56 to display indications relating to the position of the one or more wellhead components.

Additionally, in some embodiments, the running sensor feedback 360 may include feedback relating to the position and/or state of various components of the running tool 38. The controller 50 may cause the I/O device 56 to provide indications relating to the position and/or state of various components of the running tool 38 based on the running sensor feedback 360, which may be used by an operator to determine whether the running tool 38 is properly configured for the running process. For example, as discussed above in FIG. 3, during the running process, the valve 136 of the CHSART 100 may be in the open position, the mandrel 110 may be in a first position relative to the tool body 120, the shuttle 150 may be in a first position relative to the tool body 120, and the dogs 174 may be in a first position to engage with the casing hanger 212. Accordingly, in some embodiments, the running sensor feedback 360 may also include feedback relating to the position of the valve 136, the mandrel 110, the shuttle 150, the dogs 174, and so forth.

The landing sensor feedback 362 may include feedback relating to the landing of the one or more wellhead components (e.g., the casing hanger 212, a tubing hanger, etc.) suspended by the running tool 38 in the wellhead assembly 16 (e.g., the casing spool 22, the tubing spool 24, wellhead housing, etc.). In some embodiments, the landing sensor feedback 362 may include feedback relating to the position (e.g., elevation, depth, axial position) of the running tool 38 and/or the one or more wellhead components suspended by the running tool 38 relative to the surface 14 and/or relative to the wellhead assembly 16 (e.g., the casing spool 22, the tubing spool 24, wellhead housing, etc.). In some embodiments, the landing sensor feedback 362 may be generated using one or more pressure sensors 314, one or more motion sensors 322, and/or one or more proximity sensors 324 (e.g., optical sensors 328 and/or Hall effect sensors 332), which may be disposed in or on the running tool 38 and/or the module 46. The controller 50 may be configured to determine whether the one or more wellhead components have been properly landed in the wellhead assembly 16 based on the landing sensor feedback 362. Additionally, the controller 50 may cause the I/O device 56 to provide an indication that the one or more wellhead components are properly landed and/or an indication that the one or more wellhead components are not properly landed.

The cementing sensor feedback 364 may include feedback relating to a process for cementing one or more wellhead components (e.g., the casing string 218, the string 220, etc.) in the well 20. For example, as discussed below, the cementing sensor feedback 364 may include feedback relating to the flow of cement through the running tool 38 (e.g., through the central bore 112), the flow of cement returns running through the running tool 38 (e.g., through the flow passages 252, 254, and/or 256), and/or the position of a valve (e.g., the valve 136) configured to selectively open and close a bore (e.g., the central bore 112) of the running tool 38 to the well 20. In some embodiments, the controller 50 may determine whether the cementing operations is completed based on the cementing sensor feedback 364 and may cause the I/O device 56 to display an indication indicative of the completion of the cementing operations. In certain embodiments, the controller 50 may cause the I/O device 56 to display an indication (e.g., an alarm) in response to a determination that the cementing operation is malfunctioning or was not properly completed.

The seal setting sensor feedback 366 may include feedback relating to a process for setting a seal assembly (e.g., the seal assembly 214) between a first wellhead component (e.g., the casing hanger 212, a tubing hanger, etc.) and a second wellhead component (e.g., the casing spool 22, the tubing spool 24, wellhead housing, etc.) and/or feedback relating to a state or position of the seal assembly (e.g., sealed, in sealing position, not sealed, not in sealing position, etc.). As discussed above in FIGS. 5 and 6, to set (e.g., seal) the seal assembly 214, the mandrel 110 may be moved (e.g., in the circumferential direction 108 and/or the axial direction 102) relative to the tool body 120, and then, the shuttle 150 may be moved (e.g., in the axial direction 102) relative to the tool body 120. Accordingly, in some embodiments, the seal setting sensor feedback 366 may include feedback relating to the circumferential 108 position and/or the axial 102 position of the mandrel 110 relative to the tool body 120 and/or feedback relating to the axial 102 position of the shuttle 150 relative to the tool body 120. The controller 50 may determine whether the seal assembly 214 is properly sealed based on the seal setting sensor feedback 366 and may cause the I/O device 56 to provide indications indicative of whether the seal assembly 214 is properly sealed, improperly sealed, or not sealed.

In some embodiments, the controller 50 may determine whether the mandrel 110 was properly circumferentially 108 and/or axially 102 displaced relative to the tool body 120 to determine whether the seal assembly 214 is properly sealed. For example, the controller 50 may determine the distance 270 (see FIG. 4) traveled by the mandrel 110 and may determine whether the distance 270 is approximately equal to (e.g., ±10%) of a threshold distance. In some embodiments, the threshold distance may be approximately 2 inches (in) and approximately 3 in, between approximately 2.25 in and approximately 2.75 in, or approximately 2.5 in. In some embodiments, the controller 50 may determine that the mandrel 110 was properly circumferentially 108 and/or axially 102 displaced relative to the tool body 120 in response to a determination that the mandrel 110 has moved to the second position. For example, the controller 50 may determine that the mandrel 110 is in the second position in response to a determination that the fasteners 132 have been sheared, a determination that the mandrel port 168 and the piston port 166 are aligned, and/or a determination that the distance 270 is approximately equal to the threshold distance. In some embodiments, the controller 50 may cause the I/O device 56 to provide indications relating to the position of the mandrel 110 (e.g., in the first position or in the second position).

In certain embodiments, the controller 50 may determine whether the shuttle 150 was properly axially 102 displaced relative to the tool body 120 to determine whether the seal assembly 214 was properly sealed (e.g., was properly axially 102 displaced). For example, the controller 50 may determine the distance 286 (see FIG. 6) traveled by the shuttle 150. In certain embodiments, the controller 50 may determine an axial 102 distance travelled by the seal assembly 214 based on the distance 286 and/or the axial position of the shuttle 150. In some embodiments, the axial 102 distance travelled by the seal assembly 214 may be approximately (e.g., ±10%) of the distance 286. In some embodiments, the controller 50 may determine the seal assembly 214 was properly set in response to a determination that the distance 286 (or the distance travelled by the seal assembly 214) is approximately equal to (e.g., ±10%) of a threshold distance. In some embodiments, the threshold distance may be between approximately 2 inches (in) and approximately 10 in, approximately 4 in and approximately 8 in, approximately 5 in and approximately 7 in, approximately 5.5 in and approximately 6.5 in, or approximately 5.75 in and approximately 6.25 in. In some embodiments, the controller 50 may determine that the shuttle 150 was properly axially 102 displaced relative to the tool body 120 in response to a determination that the shuttle 150 has moved to the second position. For example, the controller 50 may determine that the shuttle 150 is in the second position in response to a determination that the pins 170 and/or the tensile bolts 184 have been sheared or broken and/or a determination that the distance 286 is approximately equal to the threshold distance. In some embodiments, the controller 50 may cause the I/O device 56 to provide indications relating to the position of the shuttle 150 (e.g., in the first position or in the second position), indications relating to the distance 286 travelled by the shuttle 150, indications relating to an axial 102 distance travelled by the seal assembly 14, and/or indications relating to whether the seal assembly 214 is properly set.

In some embodiments, the seal setting sensor feedback 366 may include feedback relating to the pressure of fluid in the running tool 38. For example, the seal setting sensor feedback 366 may include feedback relating to the pressure of fluid in the central bore 112 and/or the piston chamber 164. In some embodiments, the controller 50 may determine that the seal assembly 215 is properly sealed in response to a determination that the pressure of fluid in the central bore 112 and/or the piston chamber 164 decreased as the shuttle 150 was axially 102 displaced and then increased to a pressure approximately (e.g., ±10%) equal to a pressure threshold. For example, the pressure threshold may be between approximately 1,000 psi and approximately 4,000 psi, approximately 1,500 psi and approximately 3,000 psi, or approximately 2,000 psi and approximately 2,500 psi. In some embodiments, the pressure threshold may be approximately 2,200 psi.

The seal testing sensor feedback 368 may include feedback relating to a pressure test for the seal assembly (e.g., the seal assembly 214). For example, the seal testing sensor feedback 368 may include feedback relating to a fluid flow (e.g., pressure and/or flow rate) through the central bore 112 after fluid pressure is applied to choke or kill lines of the CHSART 100. In some embodiments, the controller 50 may determine that the seal assembly 214 is not properly set in response to a determination that a fluid is present in the central bore 112 after fluid pressure is applied to the choke or kill lines and/or a determination that the flow rate and/or pressure of fluid in the central bore 112 after fluid pressure is applied to the choke or kill lines exceeds a respective threshold. In some embodiments, the seal testing sensor feedback 368 may include feedback relating to the position of the shuttle 150 relative to the tool body 120. For example, the controller 50 may determine whether the shuttle 150 returned to the first position after fluid pressure is applied to choke or kill lines based on the seal testing sensor feedback 368.

The releasing sensor feedback 370 may include feedback relating to the coupling between the running tool 38 and the one or more wellhead components suspended by the running tool 38. For example, the releasing sensor feedback 370 may include feedback relating to the position of the dogs 174 (e.g., the first radial 106 position or the second radial 106 position) and/or the position of the cam ring 172 (e.g., the first axial 102 position or the second axial 102 position). The controller 50 may determine that the CHSART 100 is uncoupled from the casing hanger 212 in response to a determination that the dogs 174 are in the second radial 106 position and/or a determination that the cam ring 172 is in the second axial 102 position. In some embodiments, the releasing sensor feedback 70 may include feedback relating to a rotation (e.g., circumferential 108 rotation) of the mandrel 110. For example, in some embodiments, the controller 50 may determine the position of the dogs 174, the position of the cam ring 172, and/or the coupling between the CHSART 100 and the casing hanger 210 based on the rotation of the mandrel 110. In certain embodiments, the controller 110 may determine that the dogs 174 are in the second radial 106 position, the cam ring 172 is in the second axial 102 position, and/or the CHSART 100 is uncoupled from the casing hanger 212 in response to a determination that the rotation of the mandrel is approximately equal to a rotation threshold. For example, the rotation threshold may be approximately equal to four 360 degree rotations or approximately 1,400 degrees. The controller 50 may cause the I/O device 56 to display indications indicative of the position of the dogs 174, the position of the cam ring 172, the rotation of the mandrel 110, and/or the coupling (e.g., coupled or uncoupled) between the running tool 38 (e.g., the CHSART 100) and the wellhead component (e.g., the casing hanger 212).

The raising sensor feedback 372 may include feedback relating to the raising or retrieving of the running tool 38 to the surface 14. For example, the raising sensor feedback 372 may include feedback relating to the position (e.g., depth or elevation) of the running tool 38 relative to the surface 14. In some embodiments, the controller 50 may determine the depth of the running tool 38 relative to the surface 14 and may cause the I/O device 56 to display graphical and/or numerical indications of the depth.

Figure 15:
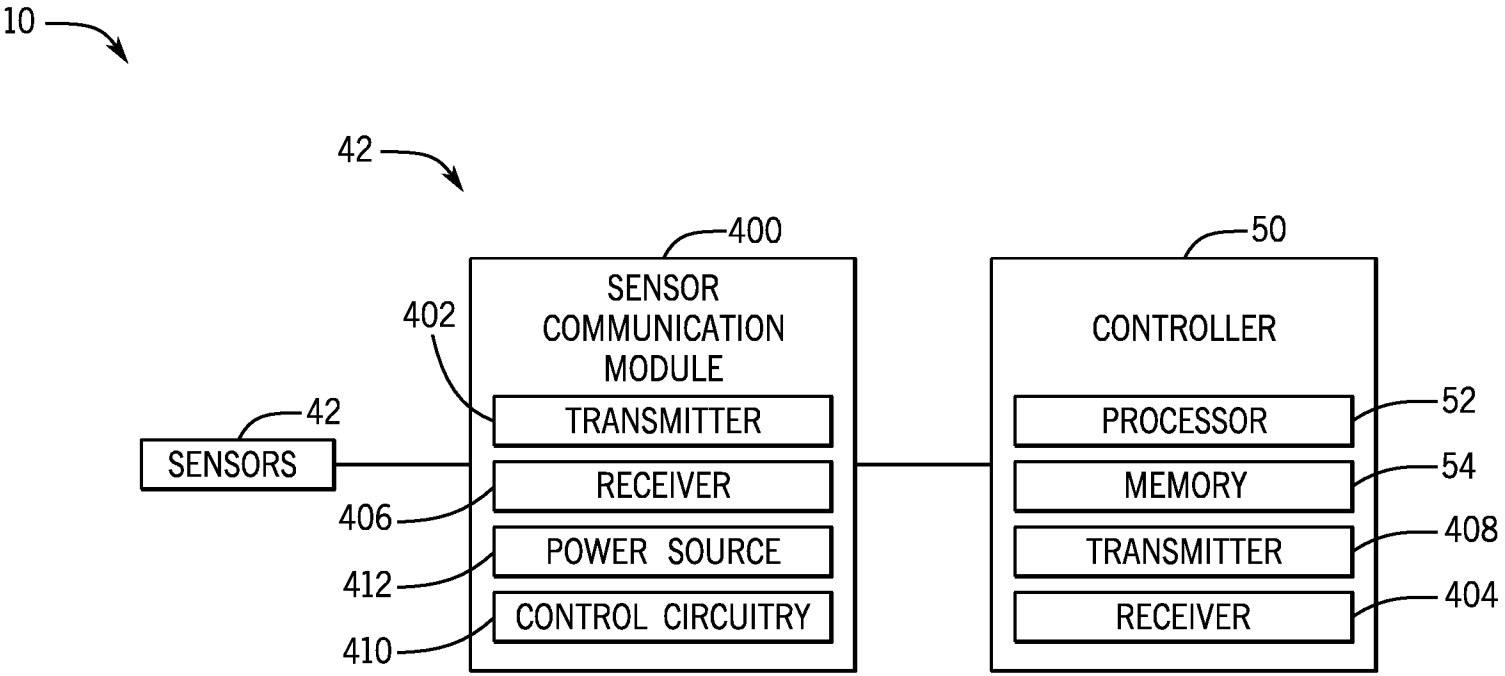
FIG. 15 is a block diagram of an embodiment of the control system of FIG. 1 including a controller, a plurality of sensors, and a sensor communication module.

FIG. 15 illustrates a block diagram of the control system 42 including the sensors 44, the controller 50, and a sensor communication module 400 (e.g., a first communication module). The sensor communication module 400 may be disposed proximate to the running tool 38 and the plurality of sensors 44. For example, the sensor communication module 400 may be disposed in the running tool 38 (e.g., the CHSART 100), the module 46, the drill string 40, the casing string 218, the string 220, and/or in any other suitable component of the mineral extraction system 10. The sensor communication module 400 may be communicatively coupled to one or more of the sensors 44 via one or more wired connections (e.g., cables). In some embodiments, the control system 42 may include a sensor communication module 400 for each sensor 44.

The sensor communication module 400 may be configured to receive feedback from the sensors 44 and to transmit the feedback to the controller 50, which may be disposed at the surface 14. Accordingly, the sensor communication module 400 may include one or more transmitters 402 (e.g., a wireless transmitter, a wireless communication device, etc.) configured to wirelessly transmit feedback (e.g., data, signals, information, etc.) to one or more receivers 404 (e.g., a wireless receiver, a wirelessly communication device, etc.) of the controller 50. In some embodiments, the sensor communication module 400 may also include one or more receivers 406 (e.g., a wireless receiver, a wirelessly communication device, etc.) to wirelessly receive information (e.g., feedback, data, signals, control signals, etc.) from one or more transmitters 408 (e.g., a wireless transmitter, a wireless communication device, etc.) of the controller 50. In some embodiments, the transmitter 402 and the receiver 406 of the sensor communication module 400 may be combined or integrated into a single unit (e.g., a transceiver). Similarly, the receiver 404 and the transmitter 408 of the controller 50 may be combined or integrated into a single unit.

The transmitters 402 and 408 and the receivers 404 and 406 may be configured to wirelessly communicate using any suitable wireless communication techniques, such as acoustic telemetry (e.g., acoustics through steel, acoustics through the drill string 40), inductive telemetry, mud pulse telemetry, electromagnetic telemetry, sonar, and so forth. In some embodiments, the transmitters 402 and 408 may be configured to transmit electrical signals (e.g., analog and/or digital signals) into acoustic waves, inductive signals, radio frequency waves, electromagnetic waves, mud pulses, and/or sonar waves and to transmit the acoustic waves, inductive signals, radio frequency waves, electromagnetic waves, mud pulses and/or sonar waves. For example, the transmitters 402 and 408 may include acoustic transducers (e.g., electroacoustic transducers), inductive elements (e.g., inductive coils), radio-frequency transmitters, light emitters (e.g., light emitting diodes), a mud pump, a mud rotor, and so forth. Accordingly, the receivers 404 and 406 may be configured to receive acoustic waves, inductive signals, radio frequency waves, electromagnetic waves, mud pulses, and/or sonar waves.

In some embodiments, the sensor communication module 400 may include control circuitry 410, which may be configured to control operation of the transmitter 402 and the receiver 406. In some embodiments, the control circuitry 410 may process (e.g., filter, amplify, modulate, demodulate, digitize, etc.) signals received from the sensors 44 before the signals are transmitted to the transmitter 402. Further, in some embodiments, the sensor communication module 400 may include a power source 412, which may power the transmitter 402, the receiver 406, and the control circuitry 410. In some embodiments, the sensor communication module 400 may transmit power from the power source 412 to the sensors 44. The power source 412 may include one or more batteries (e.g., rechargeable batteries), one or more capacitors, or any other suitable device configured to store power. In some embodiments, the power source 412 may include one or more power generating devices (e.g., energy harvesting devices) configured to generate power. For example, the power source 412 may include piezeoelectric sensors, microelectromechanical systems (MEMS), a magnet disposed in a conductive coil, or any other suitable device configured to generate power from kinetic energy. In certain embodiments, the power source 412 may be configured to receive inductive energy (e.g., from the transmitter 408 of the controller 50) and may convert the inductive energy into power (e.g., electrical current or voltage).

Figure 16:
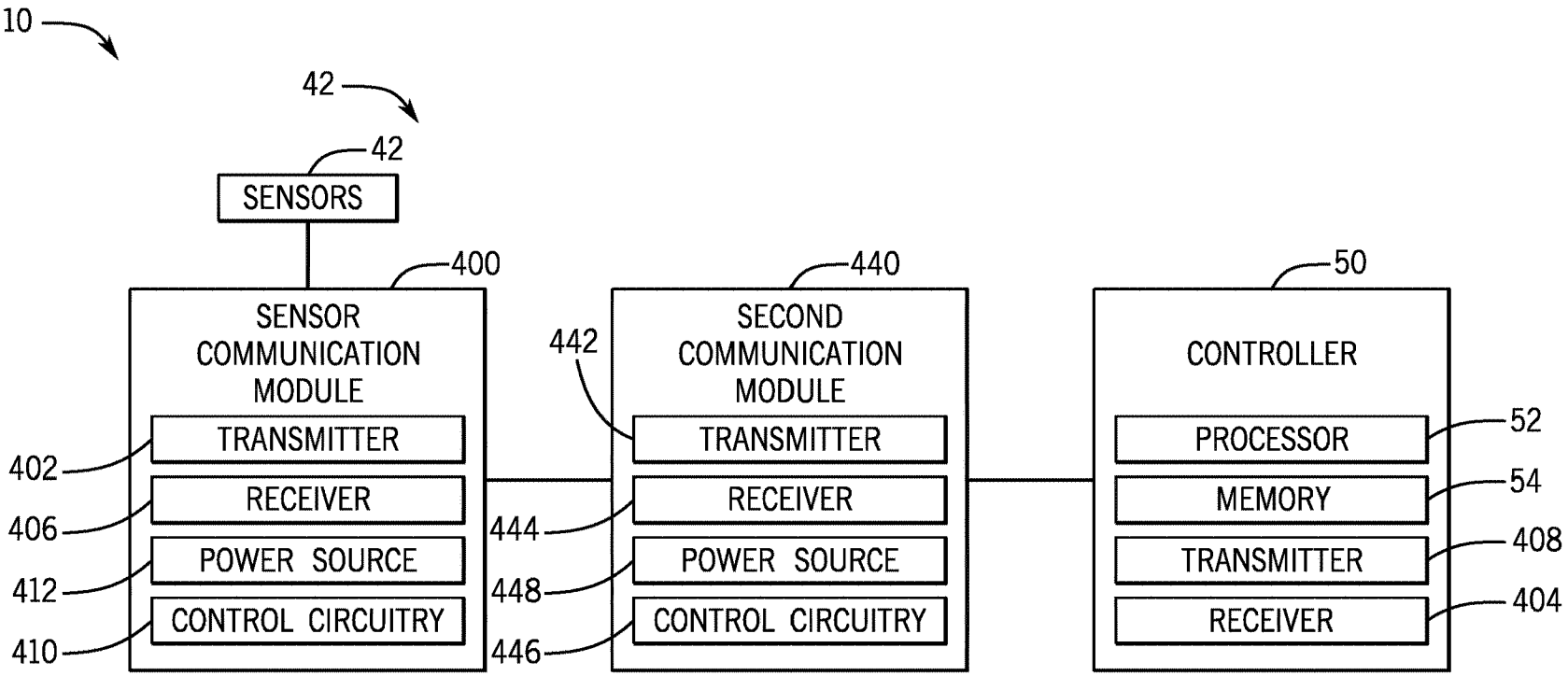
FIG. 16 is a block diagram of an embodiment of the control system of FIG. 1 including a controller, a plurality of sensors, a sensor communication module, and a second communication module.

FIG. 16 illustrates a block diagram of the control system 42 including the sensors 44, the controller 50, the sensor communication module 400, and a second communication module 440. The second communication module 440 may be local to (e.g., proximate to) the sensor communication module 400 and the running tool 38 and may be remote from the controller 50. That is, the second communication module 400 may be located 300 feet (ft), 200 ft, 100 ft, 75 ft, 50 ft, 25 ft, or less from the sensor communication module 400, and the second communication module 400 may be located 1,000 ft, 3,000 ft, 5,000 ft, 10,000 ft, or more from the controller 50. For example, the second communication module 440 may be disposed in or on a wellhead component of the wellhead assembly 16, such as wellhead housing (e.g., the casing spool 22, the tubing spool 24, a conductor, etc.), the casing hanger 214, the casing string 218, the string 220, etc. In some embodiments, the communication module 440 may be disposed in or on wellhead housing (e.g., the casing spool 22, the tubing spool 24, a conductor, etc.) that is configured to surround the running tool 38 when the running tool 38 is disposed in the wellhead assembly 16. In some embodiments, the second communication module 440 may be disposed in or on the drill string 40 (e.g., proximate to the wellhead assembly 16) or disposed in or on the module 46.

In certain embodiments, the second communication module 440 may include one or more transmitters 442, one or more receivers 444, control circuitry 446, and a power source 448. The control circuitry 446 may be configured to control the operation of the transmitter 442, the receiver 444, and the power source 448. The power source 448 may power the transmitter 442, the receiver 444, and the control circuitry 446. The power source 412 may include one or more batteries (e.g., rechargeable batteries), one or more capacitors, or any other suitable device configured to store power. In some embodiments, the power source 448 may include one or more power generating devices (e.g., energy harvesting devices) configured to generate power. For example, the power source 448 may include piezeoelectric sensors, microelectromechanical systems (MEMS), a magnet disposed in a conductive coil, or any other suitable device configured to generate power from kinetic energy. Further, in some embodiments, the transmitter 442 and the receiver 444 may be combined or integrated into a single unit (e.g., a transceiver).

The receiver 444 (e.g., wireless receiver, wireless communication device, etc.) may wirelessly receive sensor feedback (e.g., data, signals, information, etc.) from the transmitter 402 of the sensor communication module 400. In some embodiments, the receiver 444 may be configured to receive acoustic waves, inductive signals, radio frequency waves, electromagnetic waves, mud pulses, and/or sonar waves. For example, the receiver 44 may include an acoustic transducer (e.g., an electroacoustic transducer, an acoustic sensor, etc.), an inductive coil, a radio frequency receiver, an optical sensor (e.g., a photodetector), a pressure sensor, and so forth.

The second communication module 440 may transmit the sensor feedback received from the sensor communication module 400 to the controller 50. In certain embodiments, the second communication module 440 may be hardwired to the controller 50. For example, the second communication module 440 may be coupled to the controller 50 via one or more wired connections, such as one or more cables, umbilicals, and so forth. In some embodiments, the second communication module 440 may wirelessly transmit the sensor feedback to the controller 50 using the transmitter 442 (e.g., wireless transmitter, wireless communication device, etc.). In some embodiments, the transmitter 442 may be configured to transmit electrical signals (e.g., analog and/or digital signals) into acoustic waves, inductive signals, radio frequency waves, electromagnetic waves, mud pulses, and/or sonar waves and to transmit the acoustic waves, inductive signals, radio frequency waves, electromagnetic waves, mud pulses and/or sonar waves. For example, the transmitter 442 may include acoustic transducers (e.g., electroacoustic transducers), inductive elements (e.g., inductive coils), radio-frequency transmitters, light emitters (e.g., light emitting diodes), a mud pump, a mud rotor, and so forth. In some embodiments, the control circuitry 446 may process (e.g., filter, amplify, modulate, demodulate, digitize, etc.) signals received by the receiver 444 before the signals are transmitted to the transmitter 442. Further, the transmitter 442 may be configured to wirelessly transmit information (e.g., control signals, data, feedback, etc.) to the receiver 406 of the sensor communication module 400.

In some embodiments, the transmitter 442 may wirelessly transmit power from the power source 448 to the sensor communication module 400. The sensor communication module 400 may use the received power to recharge the power source 412 of the sensor communication module 400 and/or to directly power the sensors 44. In some embodiments, the transmitter 442 may inductively transmit power to the sensor communication module 400.

Figure 17:
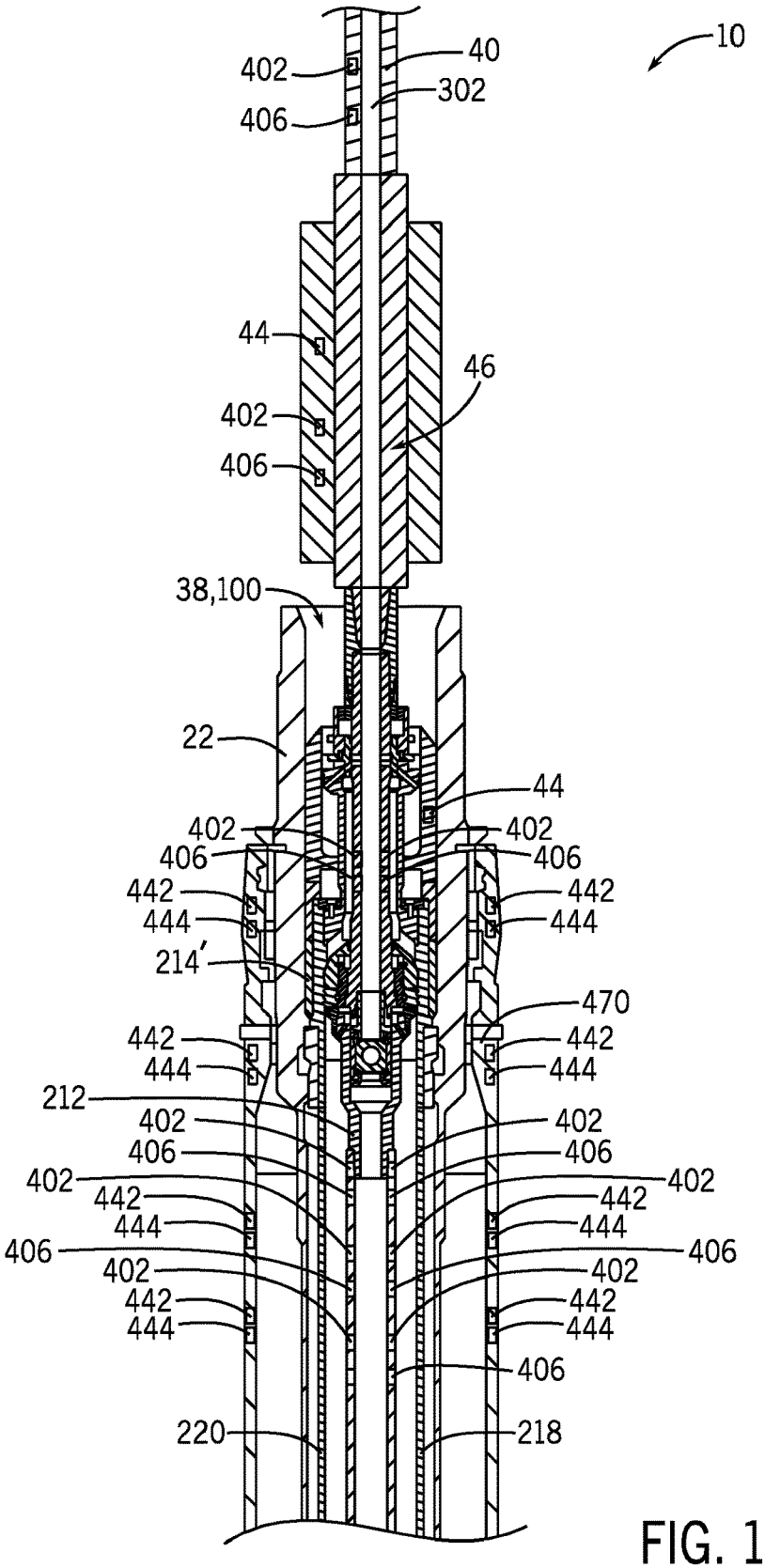
FIG. 17 is a cross-sectional view of an embodiment of the mineral extraction system including the wellhead assembly, the CHSART, the module, a plurality of sensors, and a plurality of transmitters and receivers.

FIG. 17 illustrates an embodiment of the mineral extraction system 10 including the CHSART 100, the wellhead assembly 16, the module 46, and the plurality of sensors 44. As illustrated, the sensors 44 may be disposed in the CHSART 100 and the module 46. Additionally, the mineral extraction system 10 may include a plurality of the transmitters 402 and the receivers 406 of the sensor communication module 402. For example, as illustrated, the transmitters 402 (e.g., inductive transmitters, inductive elements, inductive coils, etc.) and receivers 406 (e.g., inductive receivers, inductive elements, inductive coils, etc.) may be disposed in or on the mandrel 110, the tool body 120, and the string 220. In some embodiments, the transmitters 402 and the receivers 406 may be disposed in the casing string 118, the drill string 40, the module 46, and/or in any other suitable component of the mineral extraction system 10.

In some embodiments, the mineral extraction system 10 may include a plurality of the transmitters 442 (e.g., inductive transmitters, inductive elements, inductive coils, etc.) and the receivers 444 (e.g., inductive receivers, inductive elements, inductive coils, etc.) of the second communication module 440. For example, as illustrated, the transmitters 442 and the receivers 444 may be disposed in or on a conductor 470 (e.g., conductor housing, large diameter wellhead housing, etc.) disposed about the casing spool 22. The conductor 470 may have a larger diameter than the casing spool 22. In certain embodiments, the transmitters 442 and the receivers 444 may be disposed in or on the casing spool 22, the casing string 218, the module 46, and/or any other suitable component of the mineral extraction system 10.

In some embodiments, the transmitters 402, the receivers 406, the transmitters 442, and/or the receivers 444 may be annular (e.g., annular inductive elements, inductive rings, etc.). In certain embodiments, the transmitters 402, the receivers 406, the transmitters 442, and/or the receivers 444 may be tubular, cylindrical, and/or rectangular (e.g., may extend axially 102). In some embodiments, the plurality of transmitters 402, the plurality of receivers 406, the plurality of transmitters 442, and/or the plurality of receivers 444 may each be disposed in an axial 102 arrangement (e.g., axially 102 spaced apart) and/or a circumferential 108 arrangement (e.g., circumferentially 108 spaced apart).

Reference throughout this specification to "one embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

Although the present disclosure has been described with respect to specific details, it is not intended that such details should be regarded as limitations on the scope of the invention, except to the extent that they are included in the accompanying claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A mineral extraction system, comprising:

a running tool configured to carry and install a wellhead component in a wellhead assembly during an installation process;

a plurality of sensors, wherein each sensor of the plurality of sensors is configured to generate a signal indicative of at least one parameter of a plurality of parameters of the running tool during the installation process;

a controller disposed on a base vessel, wherein the controller is in wireless communication with the plurality of sensors, and the controller is configured to receive the signal from each sensor of the plurality of sensors, to determine the plurality of parameters of the running tool based on the signals received from the plurality of sensors, and to provide one or more user-perceivable indications based on the plurality of parameters;

a first communication module comprising a first transmitter, wherein the first communication module is configured to receive signals from one or more sensors of the plurality of sensors via one or more first wired connections; and a second communication module comprising a first receiver, wherein the first transmitter is configured to wirelessly transmit the signals from the one or more sensors of the plurality of sensors to the first receiver, and wherein the second communication module is configured to transmit the signals received from the first transmitter to the controller.

2. The system of claim 1, wherein the first transmitter comprises a first inductive element, the first receiver comprises a second inductive element, and the first inductive element is configured to inductively transmit the signals from the one or more sensors of the plurality of sensors to the second inductive element.

3. The system of claim 2, wherein the second communication module comprises a first power source, and the second inductive element is configured to inductively transmit power from the first power source to the first inductive element of the first communication module.

4. The system of claim 3, wherein the first communication module comprises a second power source, the first communication module is configured to use the power received from the second inductive element to recharge the second power source, and the first communication module is configured to power the one or more sensors of the plurality of sensors using the second power source.

5. The system of claim 3, wherein the first power source comprises an energy harvesting device configured to harvest kinetic or thermal energy.

6. The system of claim 1, wherein the second communication module is configured to transmit the signals received from the first transmitter to the controller via one or more second wired connections.

7. The system of claim 1, wherein the second communication module comprises a second transmitter, and the second transmitter is configured to wirelessly transmit the signals received from the first transmitter to the controller.

8. The system of claim 7, wherein the second transmitter is configured to acoustically transmit the signals to the controller.

9. The system of claim 1, wherein the first transmitter is disposed in or on the running tool, a drill string carrying the running tool, or a string carried by the running tool, the first receiver is disposed in or on a wellhead housing of the wellhead assembly, and the wellhead housing is configured to surround the running tool when the running tool is disposed in the wellhead assembly.

10. The system of claim 1, wherein the running tool is configured to carry a casing hanger and a seal assembly, to land the casing hanger in wellhead housing of the wellhead assembly, and to set the seal assembly between the casing hanger and the wellhead housing, and wherein the running tool comprises:

a mandrel having a bore extending through the mandrel;

a tool body coupled to the mandrel, wherein the tool body is configured to carry the casing hanger and the seal assembly; and a shuttle coupled to the tool body, wherein the mandrel and the shuttle are configured to move axially along a longitudinal axis of the running tool relative to the tool body to set the seal assembly; and wherein one or more sensors of the plurality of sensors are configured to generate a first signal indicative of an axial position of the mandrel relative to the tool body and a second signal indicative of an axial position of the shuttle relative to the tool body.

11. The system of claim 1, wherein one or more sensors of the plurality of sensors are disposed in or on the running tool.

12. The system of claim 1, comprising:

a drill string configured to carry and lower the running tool; and a module comprising a mandrel surrounding the drill string and a first bore extending through the mandrel, wherein the first bore is coaxial with a second bore of the drill string, the module and the running tool are positioned on the drill string such that the module is closer to the base vessel than the running tool, and one or more sensors of the plurality of sensors are disposed in or on the module.

13. A subsea mineral extraction system, comprising:

a running tool configured to carry a casing hanger and a seal assembly, to land the casing hanger in wellhead housing of a subsea wellhead assembly, and to set the seal assembly between the casing hanger and the wellhead housing during an installation process, wherein the running tool comprises:

a mandrel configured to couple to a drill string configured to lower the running tool into the wellhead housing;

a central bore extending through the mandrel and axially along a longitudinal axis of the running tool;

a tool body coupled to the mandrel, wherein the tool body is configured to carry the casing hanger and the seal assembly;

a shuttle disposed about the tool body, wherein the shuttle is sealed to the tool body via one or more seals, and the shuttle and the mandrel are configured to move axially along the longitudinal axis of the running tool relative to the tool body to set the seal assembly; and a plurality of sensors, wherein each sensor of the plurality of sensors is configured to generate a signal indicative of at least one parameter of a plurality of parameters of the running tool during the installation process, and one or more sensors of the plurality of sensors are configured to generate a first signal indicative of an axial position of the mandrel relative to the tool body and a second signal indicative of an axial position of the shuttle relative to the tool body.

14. The system of claim 13, comprising a controller configured to:

receive the signal from each sensor of the plurality of sensors;

determine the plurality of parameters of the running tool based on the signals received from plurality of sensors, wherein the plurality of parameters comprise the axial position of the mandrel relative to the tool body and the axial position of the shuttle relative to the tool body; and provide one or more user-perceivable indications based on the plurality of parameters.

15. The system of claim 14, wherein the running tool comprises a valve configured to selectively open and close the central bore when the valve is in an open position and a closed position, respectively, and wherein the controller is configured to determine whether the valve is in the open position or the closed position based on the axial position of the mandrel relative to the tool body.

16. The system of claim 14, wherein the controller is configured to determine whether the seal assembly is properly set between the casing hanger and the wellhead housing based on the axial position of the mandrel relative to the tool body and the axial position of the shuttle relative to the tool body.

17. The system of claim 14, wherein at least one sensor of the plurality of sensors is configured to generate a third signal indicative of an axial position of the running tool relative to the wellhead assembly or relative to a surface vessel having the controller, and wherein the controller is configured to determine the axial position of the running tool relative to the wellhead assembly or relative to the surface vessel based on the third signal.

18. The system of claim 14, comprising:

a first communication module communicatively coupled to the one or more sensors of the plurality of sensors via one or more wired connections, wherein the first communication module comprises a first transmitter; and a second communication module communicatively coupled to the first communication module and the controller, wherein the second communication module comprises a first receiver, the first transmitter is configured to wirelessly transmit the first and second signals from the one or more sensors of the plurality of sensors to the first receiver, the second communication module is configured to transmit the first and second signals to the controller, and the controller is remote from the first and second communication modules.

19. A method of monitoring a running tool, comprising:

receiving a plurality of signals from a plurality of sensors, wherein each sensor of the plurality of sensors is configured to generate a signal indicative of at least one parameter of the running tool during an installation process executed using the running tool, wherein, during the installation process, the running tool is configured to carry a casing hanger and a seal assembly, to land the casing hanger in a wellhead housing of a wellhead assembly, and to set the seal assembly between the casing hanger and the wellhead housing;

determining a plurality of parameters of the running tool based on the plurality of signals, wherein the plurality of parameters comprise at least two different parameters selected from parameters comprising a position of the running tool relative to the wellhead housing, an elevation of the running tool relative to a base vessel, a position of a valve of the running tool, a position of a shuttle of the running tool, a position of one or more ports of the running tool, a position of one or more dogs of the running tool, a position of or distance traveled by the seal assembly relative to the running tool, a broken or unbroken condition of one or more parts of the running tool, a pressure of a fluid flowing through the running tool, or a combination thereof; and providing one or more user-perceivably indications based on the plurality of parameters.

20. The method of claim 19, wherein the plurality of parameters comprise at least three different parameters selected from the parameters.

* * * * *